US011384963B2

(12) United States Patent
Xu et al.

(10) Patent No.: US 11,384,963 B2
(45) Date of Patent: Jul. 12, 2022

(54) GM CRYOCOOLER

(71) Applicant: SUMITOMO HEAVY INDUSTRIES, LTD., Tokyo (JP)

(72) Inventors: Mingyao Xu, Nishitokyo (JP); Qian Bao, Nishitokyo (JP); Takaaki Morie, Yokosuka (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 109 days.

(21) Appl. No.: 16/425,950

(22) Filed: May 30, 2019

(65) Prior Publication Data

US 2019/0277542 A1 Sep. 12, 2019

Related U.S. Application Data

(63) Continuation of application No. PCT/JP2017/042656, filed on Nov. 28, 2017.

(30) Foreign Application Priority Data

Nov. 30, 2016 (JP) ..... JP2016-232916
Jul. 10, 2017 (JP) ..... JP2017-134376

(51) Int. Cl.
*F25B 9/14* (2006.01)

(52) U.S. Cl.
CPC ..... *F25B 9/14* (2013.01); *F25B 9/145* (2013.01); *F25B 2309/006* (2013.01); *F25B 2309/1421* (2013.01)

(58) Field of Classification Search
CPC ..... F25B 9/14; F25B 9/145; F25B 2309/006; F25B 2309/1421
See application file for complete search history.

(56) References Cited

U.S. PATENT DOCUMENTS

| | | | | |
|---|---|---|---|---|
| 3,188,819 | A | 6/1965 | Hogan | |
| 4,412,423 | A | 11/1983 | Durenec | |
| 5,461,859 | A * | 10/1995 | Beale | F02B 71/04 60/517 |
| 9,080,794 | B2 * | 7/2015 | Longsworth | F25B 9/06 |
| 2013/0074523 | A1 | 3/2013 | Xu | |
| 2015/0068221 | A1 * | 3/2015 | Morie | F25B 9/14 62/6 |

FOREIGN PATENT DOCUMENTS

| | | | |
|---|---|---|---|
| JP | H02-213654 | A | 8/1990 |
| JP | 2000-121186 | A | 4/2000 |
| JP | 2013-083428 | A | 5/2013 |
| JP | 2013-522576 | A | 6/2013 |

* cited by examiner

*Primary Examiner* — Nael N Babaa
(74) *Attorney, Agent, or Firm* — HEA Law PLLC

(57) ABSTRACT

A GM cryocooler includes a displacer that is reciprocatable in an axial direction; a displacer cylinder that houses the displacer; a drive piston that is coupled to the displacer so as to drive the displacer in the axial direction; and a piston cylinder that houses the drive piston and that includes a drive chamber of which a pressure is controlled to drive the drive piston, and a gas spring chamber which is airtightly formed with respect to the displacer cylinder and is partitioned from the drive chamber by the drive piston.

11 Claims, 21 Drawing Sheets

GM CRYOCOOLER

RELATED APPLICATIONS

Priority is claimed to Japanese Patent Application No. 2016-232916, filed Nov. 30, 2016 and Japanese Patent Application No. 2017-134376, filed Jul. 10, 2017, and International Patent Application No. PCT/JP2017/042656, the entire content of each of which is incorporated herein by reference.

BACKGROUND

Technical Field

Certain embodiments of the present invention relate to a Gifford-McMahon (GM) cryocooler.

Description of Related Art

GM cryocoolers are roughly divided into two types, a motor driven type and a gas driven type depending on drive sources thereof. In the motor driven type, a displacer is mechanically coupled to a motor and is driven by the motor. In the gas driven type, the displacer is driven by a gas pressure.

SUMMARY

According to an embodiment of the invention, a GM cryocooler includes a displacer that is reciprocatable in an axial direction; a displacer cylinder that houses the displacer; a drive piston that is coupled to the displacer so as to drive the displacer in the axial direction; and a piston cylinder that houses the drive piston and that includes a drive chamber of which a pressure is controlled to drive the drive piston, and a gas spring chamber which is airtightly formed with respect to the displacer cylinder and is partitioned from the drive chamber by the drive piston.

DETAILED DESCRIPTION

Figure 1:
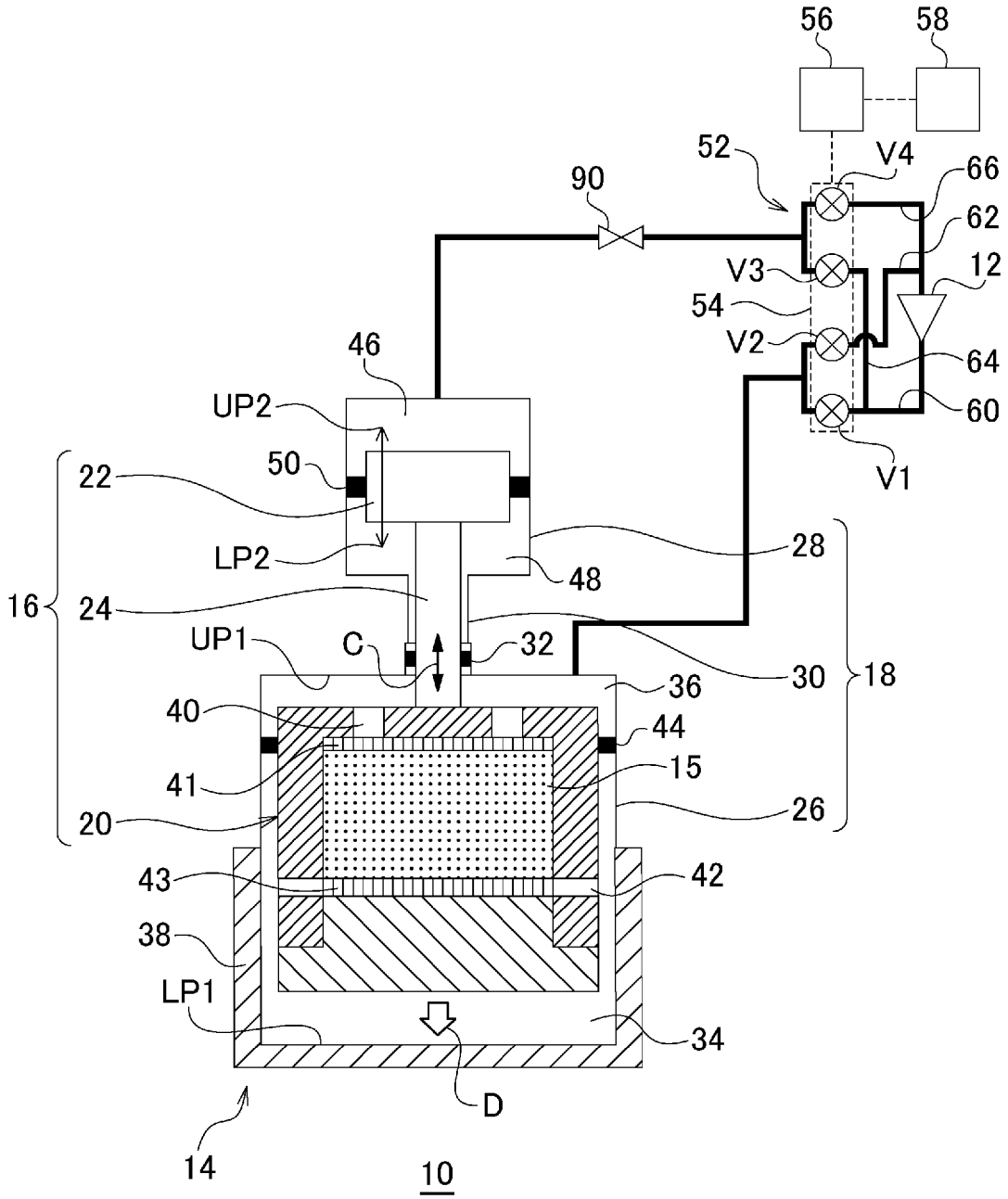
FIG. 1 is a schematic view illustrating a GM cryocooler related to a first embodiment.

In the case of the motor driven type, a stroke of the displacer is determined by a coupling mechanism. Therefore, it is easy to design the motor-driven GM cryocooler so as for the displacer not collide against a cylinder. For example, if a slight gap is provided between a bottom dead center of the displacer and a bottom surface of the cylinder, a collision between the displacer and the cylinder is avoided. Meanwhile, in typical gas-driven GM cryocoolers, the displacer continues moving due to the action of the gas pressure until the displacer collides against or come into contact with the bottom surface of the cylinder. The collision or contact of the displacer with the cylinder may become a cause of vibration or abnormal noise.

It is desirable to reduce vibration or abnormal noise of a gas-driven GM cryocooler.

In addition, optional combinations of the above constituent elements and those obtained by substituting the constituent elements or expressions of the invention with each other among methods, devices, systems, and the like are also effective as aspects of the inventions.

According to the invention, vibration or abnormal noise of the gas-driven GM cryocooler can be reduced.

Hereinafter, embodiments for carrying out the invention will be described in detail. In addition, the configuration to be described below is merely exemplary and does not limit the range of the invention at all. Additionally, in the description of the drawing, the same elements will be designated by the same reference signs, and the duplicate description thereof will be appropriately omitted. Additionally, in the drawings to be referred to in the following description, the size and thickness of respective constituent members are for convenience of description, and do not necessarily indicate actual dimensions and ratios.

First Embodiment

FIG. 1 is a schematic view illustrating a GM cryocooler 10 related to a first embodiment.

The GM cryocooler 10 includes a compressor 12 that compresses a working gas (for example, helium gas), and a cold head 14 that cools the working gas by adiabatic expansion. The cold head 14 is also referred to as an expander. As will be described below in detail, the compressor 12 supplies a high-pressure working gas to the cold head 14. The cold head 14 is provided with a regenerator 15 that pre-cools the working gas. The pre-cooled working gas is further cooled due to expansion within the cold head 14. The working gas is collected in the compressor 12 through the regenerator 15. The working gas cools the regenerator 15 when the working gas passes through the regenerator 15. The compressor 12 compresses the collected working gas and supplies the compressed working gas to the cold head 14 again.

The cold head 14 illustrated is of a single stage type. However, the cold head 14 may be of a multistage type.

The cold head 14 is of a gas driven type. Therefore, the cold head 14 includes an axial movable body 16 serving as a free piston to be driven by a gas pressure, and a cold head housing 18 that is airtightly configured and houses the axial movable body 16. The cold head housing 18 supports the axial movable body 16 so as to be reciprocatable in an axial direction. Unlike a motor-driven GM cryocooler, the cold head 14 does not have a motor that drives the axial movable body 16, and a coupling mechanism (for example, a scotch yoke mechanism).

The axial movable body 16 includes a displacer 20 that is reciprocatable in the axial direction (an upward-downward direction, indicated by an arrow C illustrate FIG. 1), and a drive piston 22 coupled to the displacer 20 such that the displacer 20 is driven in the axial direction. The drive piston 22 is disposed coaxially with the displacer 20 and apart therefrom in the axial direction.

The cold head housing 18 includes a displacer cylinder 26 that houses the displacer 20, and a piston cylinder 28 that houses the drive piston 22. The piston cylinder 28 is disposed coaxially with the displacer cylinder 26 and adjacent thereto in the axial direction.

Although described below in detail, a drive unit of the cold head 14 that is of the gas driven type is configured to include the drive piston 22 and the piston cylinder 28. Additionally, the cold head 14 includes a gas spring mechanism that acts on the drive piston 22 so as to alleviate or prevent a collision or contact between the displacer 20 and the displacer cylinder 26.

Additionally, the axial movable body 16 includes a coupling rod 24 that rigidly couples the displacer 20 to the drive piston 22 such that the displacer 20 reciprocates in the axial direction integrally with the drive piston 22. The coupling rod 24 also extends from the displacer 20 to the drive piston 22 coaxially with the displacer 20 and the drive piston 22.

The drive piston 22 has dimensions smaller than the displacer 20. The axial length of the drive piston 22 is shorter than that of the displacer 20, and the diameter of the drive piston 22 is also smaller than that of the displacer 20. The diameter of the coupling rod 24 is smaller than that of the drive piston 22.

The volume of the piston cylinder 28 is smaller than that of the displacer cylinder 26. The axial length of the piston cylinder 28 is shorter than that of the displacer cylinder 26, and the diameter of the piston cylinder 28 is also smaller than that of the displacer cylinder 26.

In addition, a dimensional relationship between the drive piston 22 and the displacer 20 is not limited to the above-described one, and may be different from that. Similarly, the dimensional relationship between the piston cylinder 28 and the displacer cylinder 26 is not limited to the above-described one, and may be different from that.

The axial reciprocation of the displacer 20 is guided by the displacer cylinder 26. Typically, the displacer 20 and the displacer cylinder 26 are respectively cylindrical members that extend in the axial direction, and the internal diameter of the displacer cylinder 26 coincides with or is slightly larger than the external diameter of the displacer 20. Similarly, the axial reciprocation of the drive piston 22 is guided by the piston cylinder 28. Typically, the drive piston 22 and the piston cylinder 28 are respectively cylindrical members that extend in the axial direction, and the internal diameter of the piston cylinder 28 coincide with or is slightly larger than the external diameter of the drive piston 22.

Since the displacer 20 and the drive piston 22 are rigidly coupled to each other by the coupling rod 24, the axial stroke of the drive piston 22 is equal to the axial stroke of the displacer 20, and both the displacer and the drive piston move integrally over the entire stroke. The position of the drive piston 22 with respect to the displacer 20 is invariable during the axial reciprocation of the axial movable body 16.

Additionally, the cold head housing 18 includes a coupling rod guide 30 that connects the displacer cylinder 26 to the piston cylinder 28. The coupling rod guide 30 extends from the displacer cylinder 26 to the piston cylinder 28 coaxially with the displacer cylinder 26 and the piston cylinder 28. The coupling rod 24 passes through the coupling rod guide 30. The coupling rod guide 30 is configured as a bearing that guides the axial reciprocation of the coupling rod 24.

The displacer cylinder 26 is airtightly coupled with the piston cylinder 28 via the coupling rod guide 30. In this way, the cold head housing 18 is configured as a pressure vessel for the working gas. In addition, the coupling rod guide 30 may be regarded as being a portion of the displacer cylinder 26 or the piston cylinder 28.

A first seal part 32 is provided between the coupling rod 24 and the coupling rod guide 30. The first seal part 32 is mounted on any one of the coupling rod 24 or the coupling rod guide 30, and slides on the other of the coupling rod 24 or the coupling rod guide 30. The first seal part 32 is constituted of, for example, a seal member, such as a slipper seal or an O-ring. The piston cylinder 28 is airtightly configured with respect to the displacer cylinder 26 by the first seal part 32. In this way, the piston cylinder 28 is fluidly isolated from the displacer cylinder 26, and a direct gas flow between the piston cylinder 28 and the displacer cylinder 26 is not generated.

The displacer cylinder 26 is partitioned into an expansion chamber 34 and a room temperature chamber 36 by the displacer 20. The displacer 20 forms the expansion chamber 34 between the displacer 20 and the displacer cylinder 26 at one axial end thereof, and forms the room temperature chamber 36 between the displacer 20 and the displacer cylinder 26 at the other axial end thereof. The expansion chamber 34 is disposed on a bottom dead center LP1 side, and the room temperature chamber 36 is disposed on a top dead center UP1 side. Additionally, the cold head 14 is provided with a cooling stage 38 anchored to the displacer cylinder 26 so as to envelop the expansion chamber 34.

The regenerator 15 is built in the displacer 20. The displacer 20 has an inlet flow path 40, which allows the regenerator 15 to communicate with the room temperature chamber 36, at an upper lid part thereof. Additionally, the displacer 20 has an outlet flow path 42, which allows the regenerator 15 to communicate with the expansion chamber 34, at a tube part thereof. Alternatively, the outlet flow path 42 may be provided at a lower lid part of the displacer 20. In addition, the displacer 20 includes an inlet flow straightener 41 inscribed on the upper lid part, and an outlet flow straightener 43 inscribed on the lower lid part. The regenerator 15 is sandwiched between a pair of such flow straighteners.

A second seal part 44 is provided between the displacer 20 and the displacer cylinder 26. The second seal part 44 is, for example, a slipper seal and is mounted on the tube part or the upper lid part of the displacer 20. Since a clearance between the displacer 20 and the displacer cylinder 26 is sealed by the second seal part 44, there is no direct gas flow (that is, a gas flow that bypasses the regenerator 15) between the room temperature chamber 36 and the expansion chamber 34.

When the displacer 20 moves in the axial direction, the expansion chamber 34 and the room temperature chamber 36 are complementarily increased or decreased in volume. That is, when the displacer 20 moves downward, the expansion chamber 34 becomes narrow and the room temperature chamber 36 becomes wide. The reverse is also the same.

The working gas flows from the room temperature chamber 36 through the inlet flow path 40 into the regenerator 15. More exactly, the working gas flows from the inlet flow path 40 through the inlet flow straightener 41 into the regenerator 15. The working gas flows from the regenerator 15 via the outlet flow straightener 43 and the outlet flow path 42 into the expansion chamber 34. When the working gas returns from the expansion chamber 34 to the room temperature chamber 36, the working gas passes through a reverse route. That is, the working gas returns from the expansion chamber 34 through the outlet flow path 42, the regenerator 15, and the inlet flow path 40 to the room temperature chamber 36. The working gas to bypass the regenerator 15 and flow through the clearance is blocked by the second seal part 44.

The piston cylinder 28 includes a drive chamber 46 of which the pressure is controlled so as to drive the drive piston 22, and a gas spring chamber 48 partitioned from the drive chamber 46 by the drive piston 22. The drive piston 22 forms the drive chamber 46 between the drive piston 22 and the piston cylinder 28 at one axial end thereof, and forms the gas spring chamber 48 between the drive piston 22 and the piston cylinder 28 at the other axial end thereof. When the drive piston 22 moves in the axial direction, the drive chamber 46 and the gas spring chamber 48 are complementarily increased or decreased in volume.

The drive chamber 46 is disposed opposite to the displacer cylinder 26 in the axial direction with respect to the drive piston 22. The gas spring chamber 48 is disposed on the same side as the displacer cylinder 26 in the axial direction with respect to the drive piston 22. In other words, the drive chamber 46 is disposed on a top dead center UP2 side, and the gas spring chamber 48 is disposed on a bottom dead center LP2 side. An upper surface of the drive piston 22 receives the gas pressure of the drive chamber 46, and a lower surface of the drive piston 22 receives the gas pressure of the gas spring chamber 48.

The coupling rod 24 extends from the lower surface of the drive piston 22 through the gas spring chamber 48 to the coupling rod guide 30. Moreover, the coupling rod 24 extends to the upper lid part of the displacer 20 through the room temperature chamber 36. The gas spring chamber 48 is disposed on the same side as the coupling rod 24 with respect to the drive piston 22, and the drive chamber 46 is disposed opposite to the coupling rod 24 with respect to the drive piston 22.

A third seal part 50 is provided between the drive piston 22 and the piston cylinder 28. The third seal part 50 is, for example, a slipper seal and is mounted on a side surface of the drive piston 22. Since a clearance between the drive piston 22 and the piston cylinder 28 is sealed by the third seal part 50, there is no direct gas flow between the drive chamber 46 and the gas spring chamber 48. Additionally, since the first seal part 32 is provided, there is also no gas flow between the gas spring chamber 48 and the room temperature chamber 36. In this way, the gas spring chamber 48 is airtightly formed with respect to the displacer cylinder 26. The gas spring chamber 48 is sealed by the first seal part 32 and the third seal part 50.

When the drive piston 22 moves downward, the gas spring chamber 48 becomes narrow. In this case, the gas of the gas spring chamber 48 is compressed, and the pressure thereof is increased. The pressure of the gas spring chamber 48 acts on the lower surface of the drive piston 22 upward. Therefore, the gas spring chamber 48 generates a gas spring force that resists the downward movement of the drive piston 22.

On the contrary, when the drive piston 22 moves upward, the gas spring chamber 48 becomes wide. The pressure of the gas spring chamber 48 drops, and the gas spring force acting on the drive piston 22 also becomes small. In addition, in this case, the drive chamber 46 becomes narrow. Therefore, while a second intake valve V3 and a second exhaust valve V4 are closed, the drive chamber 46 can also be regarded as a second gas spring chamber that generates a downward gas spring force that resists the upward movement of the drive piston 22.

The cold head 14 is installed in the illustrated orientation in a field where the cold head 14 is to be used. That is, the cold head 14 is installed in a vertical orientation such that the displacer cylinder 26 is disposed on a vertically lower side and the piston cylinder 28 is disposed on a vertically upper side. In this way, when the cooling stage 38 is installed in a posture that faces the vertically lower side, the cryocooling capacity of the GM cryocooler 10 becomes the highest. However, the disposition of the GM cryocooler 10 is not limited to this. On the contrary, the cold head 14 may be installed in a posture in which the cooling stage 38 faces the vertically upper side. Alternatively, the cold head 14 may be installed sideways or in other orientations.

Moreover, the GM cryocooler 10 includes a working gas circuit 52 that connects the compressor 12 to the cold head 14. The working gas circuit 52 is configured so as to cause a pressure difference between the piston cylinder 28 (that is, the drive chamber 46) and the displacer cylinder 26 (that is, the expansion chamber 34 and/or the room temperature chamber 36). The axial movable body 16 moves in the axial direction due to the pressure difference. If the pressure of the displacer cylinder 26 is lower than that of the piston cylinder 28, the drive piston 22 moves downward, and the displacer 20 also moves downward along with this. On the contrary, if the pressure of the displacer cylinder 26 is higher than that of the piston cylinder 28, the drive piston 22 moves upward, and the displacer 20 also moves upward along with this.

The working gas circuit 52 includes a valve unit 54. The valve unit 54 includes a first intake valve V1, a first exhaust valve V2, the second intake valve V3, and the second exhaust valve V4. The second intake valve V3 and the second exhaust valve V4 may also be respectively referred to as a high-pressure valve and a low-pressure valve for driving the drive piston 22.

The valve unit 54 may be disposed in the cold head housing 18 and may be connected to the compressor 12 by piping. The valve unit 54 may be disposed outside the cold head housing 18 and may be connected to the compressor 12 and the cold head 14, respectively, by piping.

The valve unit 54 may take a rotary valve type. That is, the valve unit 54 may be configured such that the valves V1 to V4 are appropriately switched depending on rotational sliding of a valve disc with respect to a valve body. In that case, the valve unit 54 may include a rotational driving source 56 for rotationally driving the valve unit 54 (for example, the valve disc). The rotational driving source 56 is a motor. However, the rotational driving source 56 is not connected to the axial movable body 16. Additionally, the valve unit 54 may include a control unit 58 that controls the valve unit 54. The control unit 58 may control the rotational driving source 56.

In a certain embodiment, the valve unit 54 includes a plurality of individually controllable valves V1 to V4, and the control unit 58 may control opening and closing of the respective valves V1 to V4. In this case, the valve unit 54 may not include the rotational driving source 56.

The first intake valve V1 is disposed in a first intake flow path 60 that connects a discharge port of the compressor 12 to the room temperature chamber 36 of the cold head 14. The first exhaust valve V2 is disposed in a first exhaust flow path 62 that connects an intake port of the compressor 12 to the room temperature chamber 36 of the cold head 14. As illustrated, a portion of the first exhaust flow path 62 may be shared with the first intake flow path 60 on the room temperature chamber 36 side, and the remaining portion of the first exhaust flow path 62 may branch from the first intake flow path 60 on the valve unit 54 side.

The second intake valve V3 is disposed in a second intake flow path 64 that connects the discharge port of the compressor 12 to the drive chamber 46 of the piston cylinder 28. As illustrated, a portion of the second intake flow path 64 may be shared with the first intake flow path 60 on the compressor 12 side. The second exhaust valve V4 is disposed in a second exhaust flow path 66 that connects the intake port of the compressor 12 to the drive chamber 46 of the piston cylinder 28. As illustrated, a portion of second exhaust flow path 66 may be shared with the second intake flow path 64 on the drive chamber 46 side, and the remaining portion of the second exhaust flow path 66 may branch from the second intake flow path 64 on the valve unit 54 side. Additionally, a portion of second exhaust flow path 66 may be shared with the first exhaust flow path 62 on the compressor 12 side.

Figure 2:
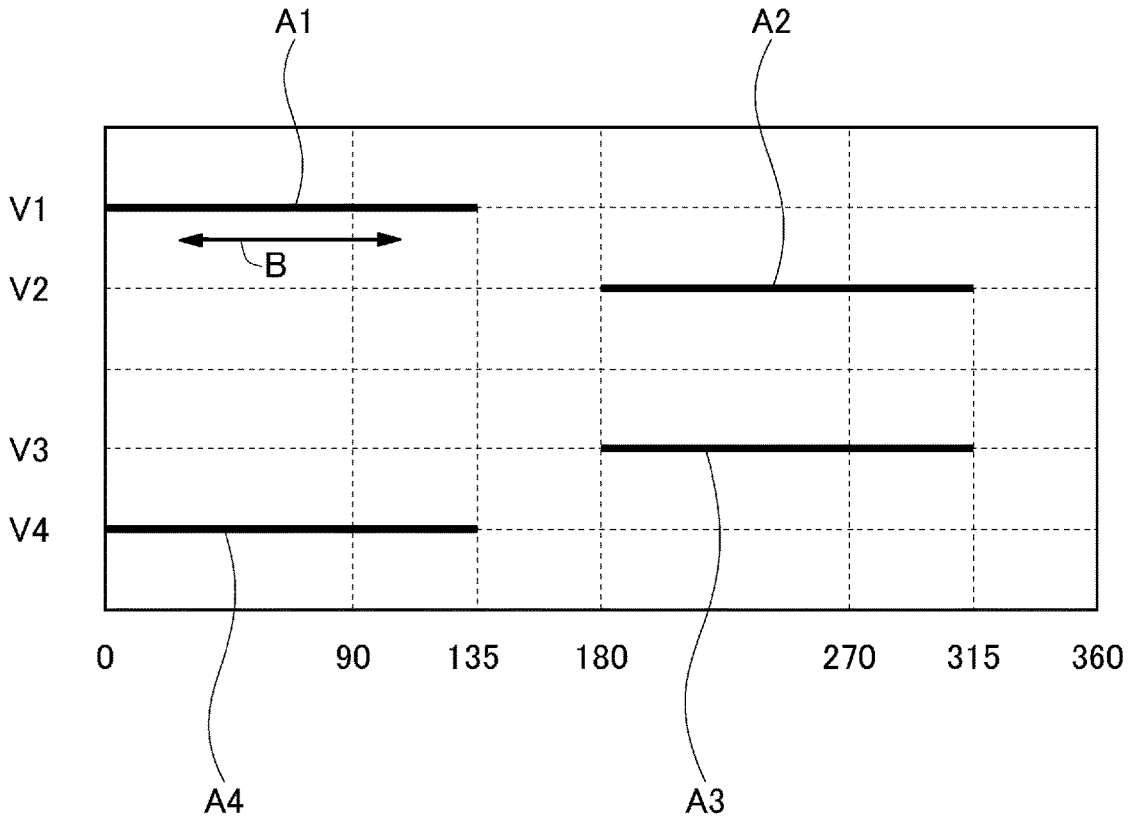
FIG. 2 is a view illustrating an example of the operation of the GM cryocooler.

FIG. 2 is a view illustrating an example of the operation of the GM cryocooler 10. Since one cycle of the axial reciprocation of the axial movable body 16 is represented in correspondence with 360 degrees in FIG. 2, 0 degree corresponds to a start point of the cycle, and 360 degrees corresponds to an endpoint of the cycle. 90 degrees, 180 degrees, and 270 degrees correspond to ¼ cycle, half cycle, and ¾ cycle, respectively.

In addition, valve timings illustrated in FIG. 2 are also applicable to those of second to fourth embodiments to be described below as well as the first embodiment.

A first intake period A1 and a first exhaust period A2 of the cold head 14 and a second intake period A3 and a second exhaust period A4 of the drive chamber 46 are illustrated in FIG. 2. The first intake period A1, the first exhaust period A2, the second intake period A3, and the second exhaust period A4 are determined by the first intake valve V1, the first exhaust valve V2, the second intake valve V3, and the second exhaust valve V4, respectively.

In the first intake period A1 (that is, when the first intake valve V1 is open), the working gas flows from the discharge port of the compressor 12 to the room temperature chamber 36. Conversely, when the first intake valve V1 is closed, supply of the working gas from the compressor 12 to the room temperature chamber 36 is stopped. In the first exhaust period A2 (that is, when the first exhaust valve V2 is open), the working gas flows from the room temperature chamber 36 to the intake port of the compressor 12. When the first exhaust valve V2 is closed, the collection of the working gas from the room temperature chamber 36 to the compressor 12 is stopped.

In the second intake period A3 (that is, when the second intake valve V3 is open), the working gas flows from the discharge port of the compressor 12 to the drive chamber 46. When the second intake valve V3 is closed, the supply of the working gas from the compressor 12 to the drive chamber 46 is stopped. In the second exhaust period A4 (that is, when the second exhaust valve V4 is open), the working gas flows from the drive chamber 46 to the intake port of the compressor 12. When the second exhaust valve V4 is closed, the collection of the working gas from the drive chamber 46 to the compressor 12 is stopped.

In an example illustrated in FIG. 2, the first intake period A1 and the second exhaust period A4 are within a range of 0 degree to 135 degrees, and the first exhaust period A2 and the second intake period A3 are within a range of 180 degrees to 315 degrees. The first intake period A1 alternates with and does not overlap the first exhaust period A2, and the second intake period A3 alternates and does not overlap the second exhaust period A4. The first intake period A1 overlaps the second exhaust period A4, and the first exhaust period A2 overlaps the second intake period A3. At 0 degree, the displacer 20 and the drive piston 22 are located at or near the bottom dead centers LP1 and LP2, respectively, and at 180 degrees, the displacer 20 and the drive piston 22 are located at or near the top dead centers UP1 and UP2, respectively.

The operation of the GM cryocooler 10 having the above configuration will be described. When the displacer 20 is located at or near the bottom dead center LP1, the first intake period A1 is started (0 degree of FIG. 2). The first intake valve V1 is opened, and a high-pressure gas is supplied from the discharge port of the compressor 12 to the room temperature chamber 36 of the cold head 14. The gas is cooled while passing through the regenerator 15, and enters the expansion chamber 34.

The second exhaust period A4 is also started simultaneously with the first intake period A1 (0 degree of FIG. 2). The second exhaust valve V4 is opened, and the drive chamber 46 of the piston cylinder 28 is connected to the intake port of the compressor 12. Therefore, the drive chamber 46 has a pressure lower than the room temperature chamber 36 and the expansion chamber 34. The drive piston 22 moves from the bottom dead center LP2 toward the top dead center UP2.

The displacer 20 also moves from the bottom dead center LP1 toward the top dead center UP1 together with the drive piston 22. The first intake valve V1 is closed, and the first intake period A1 is ended (135 degrees of FIG. 2). The second exhaust valve V4 is closed, and the second exhaust period A4 is ended (135 degrees of FIG. 2). The drive piston 22 and the displacer 20 continue moving toward the top dead centers UP1 and UP2, respectively. In this way, the expansion chamber 34 is increased in volume and filled with the high-pressure gas.

When the displacer 20 is located at or near the top dead center UP1, the first exhaust period A2 is started (180 degrees of FIG. 2). The first exhaust valve V2 is opened, and the cold head 14 is connected to the intake port of the compressor 12. The high-pressure gas is expanded by the expansion chamber 34 and is cooled. The expanded gas is collected in the compressor 12 through the room temperature chamber 36 while cooling the regenerator 15.

The second intake period A3 is also started together with the first exhaust period A2 (180 degrees of FIG. 2). The second intake valve V3 is opened, and a high-pressure gas is supplied from the discharge port of the compressor 12 to the drive chamber 46 of the piston cylinder 28. Therefore, the drive chamber 46 has a pressure higher than the room temperature chamber 36 and the expansion chamber 34. The drive piston 22 moves from the top dead center UP2 toward the bottom dead center LP2.

The displacer 20 also moves from the top dead center UP1 toward the bottom dead center LP1 together with the drive piston 22. The first exhaust valve V2 is closed, and the first exhaust period A2 is ended (315 degrees of FIG. 2). The second intake valve V3 is closed, and the second intake period A3 is ended (315 degrees of FIG. 2). The drive piston 22 and the displacer 20 continue moving toward the bottom dead centers LP1 and LP2. In this way, the low-pressure gas is discharged while the volume of the expansion chamber 34 is decreased.

The cold head 14 cools the cooling stage 38 by repeating such a cooling cycle (that is, a GM cycle). Accordingly, the GM cryocooler 10 can cool a superconducting device or other objects to be cooled (not illustrated) that are thermally combined with the cooling stage 38.

As described above, since the cold head 14 is installed in a posture in which the cooling stage 38 faces the vertical lower side, gravity acts downward as indicated by an arrow D. For that reason, the weight of the axial movable body 16 acts to assist in the downward driving force of the drive piston 22. A larger driving force acts on the drive piston 22 during the downward movement compared to during the upward movement. Therefore, in the typical gas-driven GM cryocooler, a collision or contact between a displacer and a displacer cylinder easily occurs at a bottom dead center of the displacer.

However, the cold head 14 is provided with the gas spring chamber 48. The gas stored in the gas spring chamber 48 is compressed when the drive piston 22 moves downward, and the pressure thereof is increased. Since this pressure acts in a direction opposite to gravity, the driving force that acts on the drive piston 22 becomes small. The speed just before the drive piston 22 reaches the bottom dead center LP2 can be reduced.

In this way, a contact or collision between the drive piston 22 and the piston cylinder 28 and/or between the displacer 20 and the displacer cylinder 26 can be avoided. Alternatively, since collision energy is reduced due to speed reduction of the drive piston 22, for example, even if a collision has occurred, collision sound is suppressed.

Second Embodiment

Figure 3:
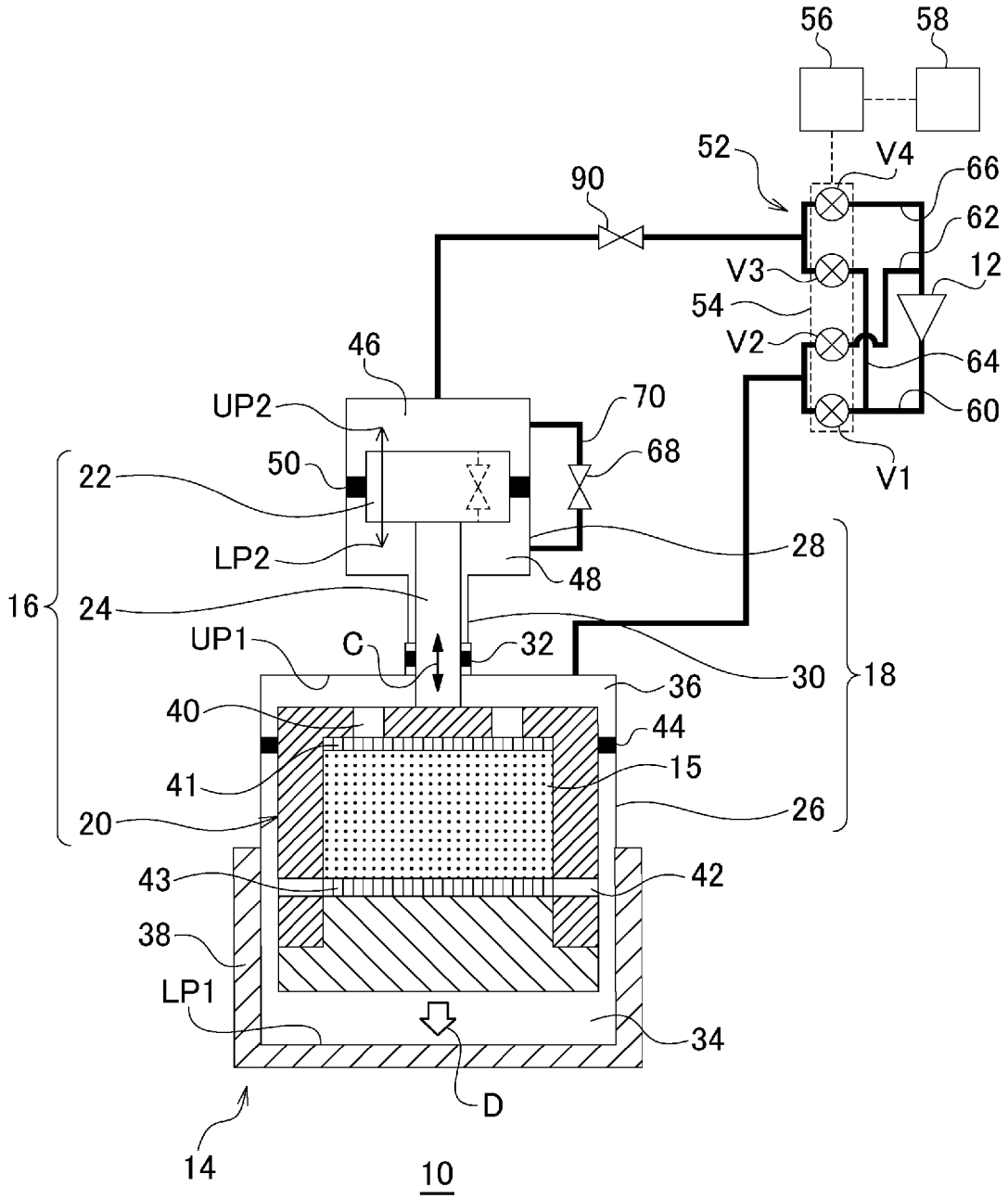
FIG. 3 is a schematic view illustrating a GM cryocooler related to a second embodiment.

FIG. 3 is a schematic view illustrating a GM cryocooler 10 related to a second embodiment. The GM cryocooler 10 related to the second embodiment is the same as the GM cryocooler 10 related to the first embodiment except that a flow path resistance part 68 that allows the gas spring chamber 48 to communicate with the drive chamber 46 is added.

The GM cryocooler 10 includes a pressure release path 70 that allows the gas spring chamber 48 to communicate with the drive chamber 46 such that the gas pressure is released from the gas spring chamber 48 to the drive chamber 46. The pressure release path 70 is provided in the piston cylinder 28 so as to shunt the gas spring chamber 48 to the drive chamber 46. The flow path resistance part 68, such as an orifice, is disposed in the middle of the pressure release path 70.

In addition, as indicated by a dashed line in FIG. 3, the pressure release path 70 and the flow path resistance part 68 may be provided in the drive piston 22.

Even in this way, similarly to the first embodiment, the gas stored in the gas spring chamber 48 is compressed when the drive piston 22 moves downward, and the pressure thereof is increased. A contact or collision between the axial movable body 16 and the cold head housing 18 is suppressed, and vibration or abnormal noise of the GM cryocooler 10 can be reduced.

Since the flow path resistance part 68 is provided, in a case where the drive piston 22 excessively moves downward and the pressure of the gas spring chamber 48 is excessively raised, the pressure can be released from the gas spring chamber 48 to the drive chamber 46. Therefore, the piston cylinder 28 is protected.

Third Embodiment

FIGS. 4 to 16 are schematic views illustrating a GM cryocooler 10 related to a third embodiment. The GM cryocooler 10 related to the third embodiment is the same as the GM cryocooler 10 related to the first embodiment except that the clearance between the drive piston 22 and the piston cylinder 28 is utilized as a flow path resistance part. Therefore, the third seal part 50 is not provided unlike the first embodiment. The gas spring chamber 48 is not sealed.

Figure 4:
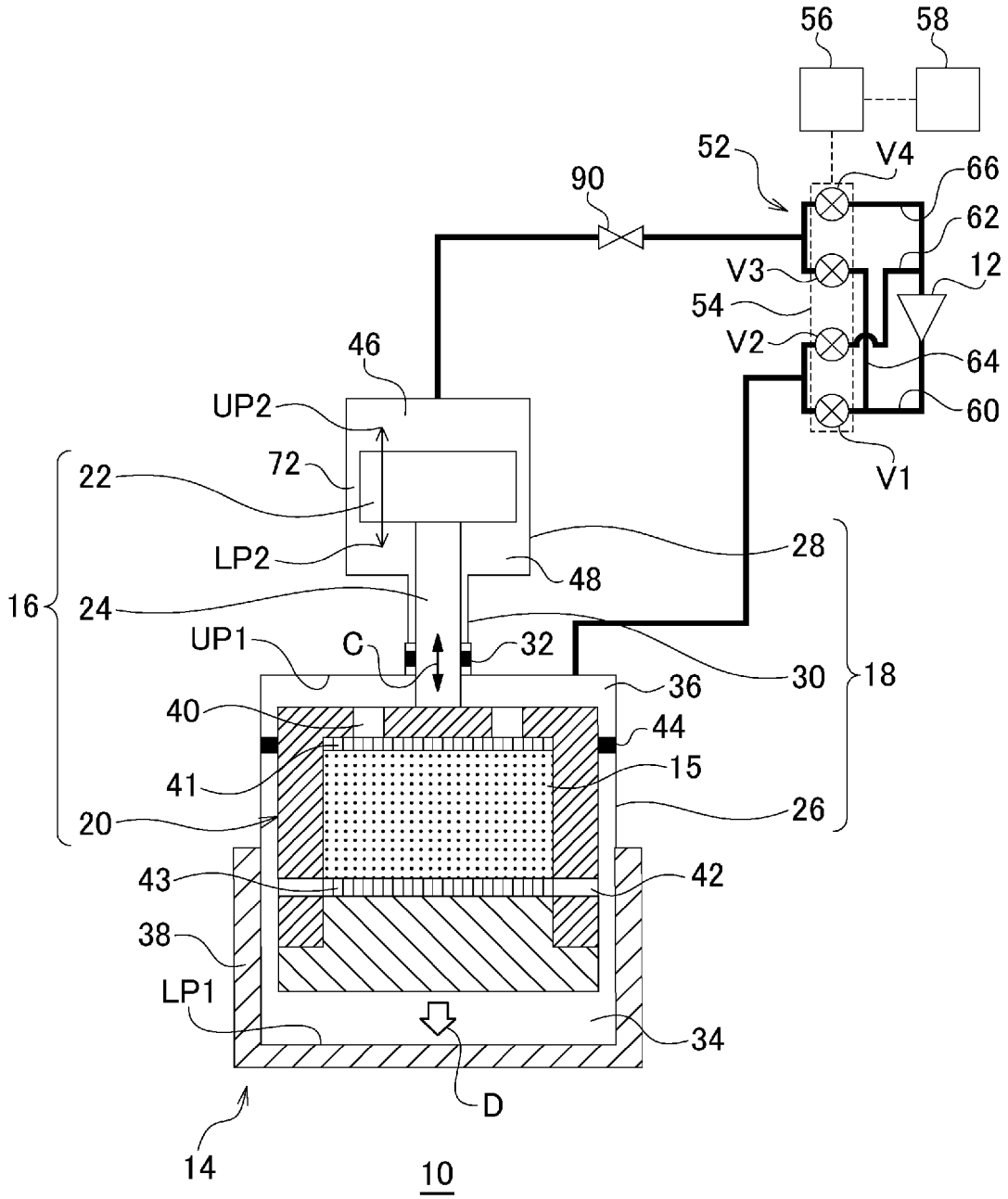
FIG. 4 is a schematic view illustrating a GM cryocooler related to a third embodiment.

As illustrated in FIG. 4, the GM cryocooler 10 includes a radial clearance 72 serving as the flow path resistance part. The gas spring chamber 48 is allowed to communicate with the drive chamber 46 through the radial clearance 72. The radial clearance 72 is formed between the drive piston 22 and the piston cylinder 28. That is, the radial clearance 72 is a radial gap that is determined depending on the external diameter of the drive piston 22 and the internal diameter of the piston cylinder 28. The radial clearance 72 is made constant in the axial direction. Even in this way, similarly to the like above-described respective embodiments, vibration or abnormal noise of the GM cryocooler 10 can be reduced.

Figure 5:
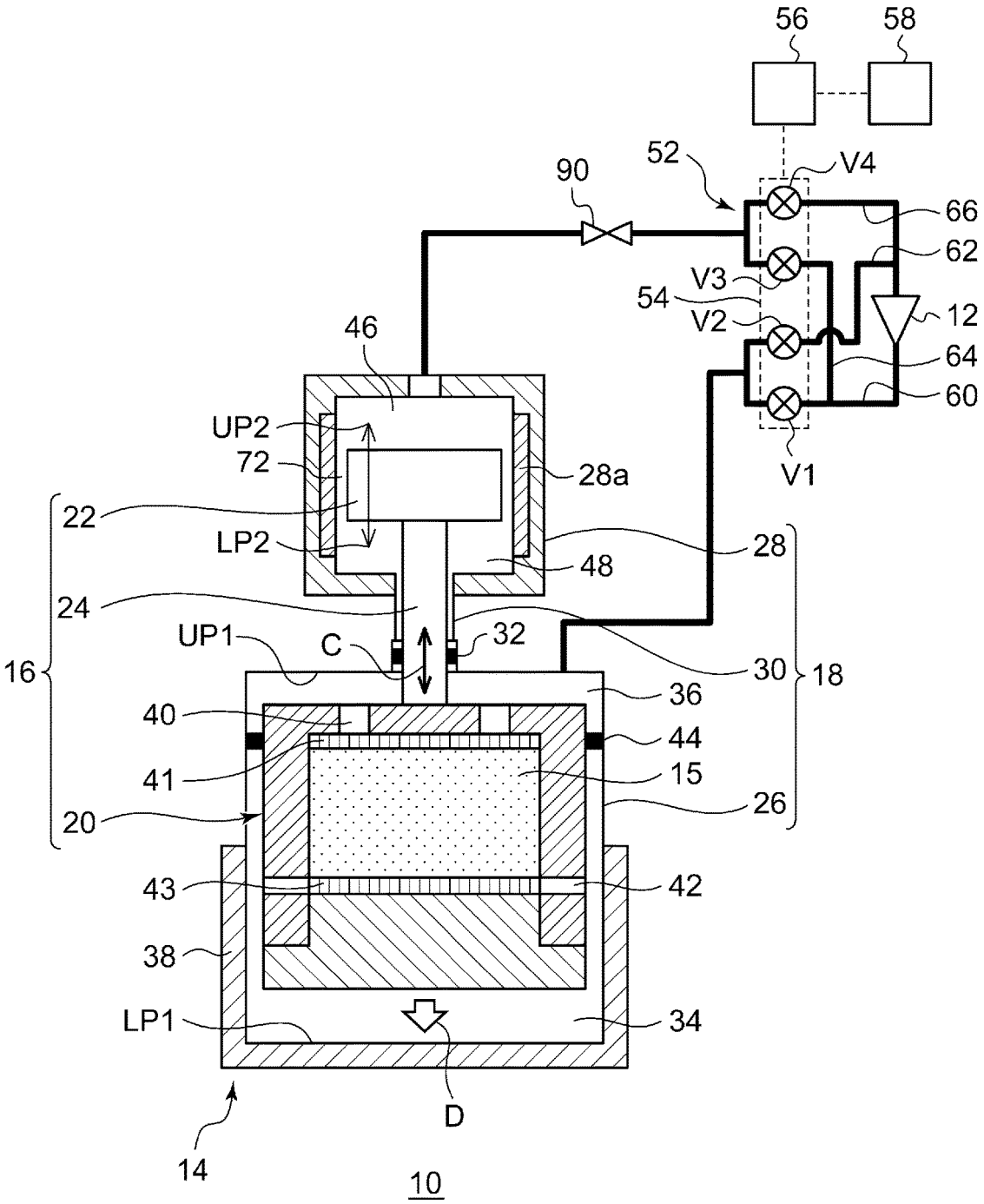
FIG. 5 is a schematic view illustrating the GM cryocooler related to the third embodiment.

As illustrated in FIG. 5, the piston cylinder 28 may include a tubular guide member 28*a*, for example, a guide bush. As the drive piston 22 slides along an inner peripheral surface of the guide member 28*a*, the guide member 28*a* can guide the drive piston 22 in the axial direction. In order to realize excellent slidability with the drive piston 22, the guide member 28*a* is formed of, for example, an appropriate resin material. The guide member 28*a* may be disposed in the piston cylinder 28 so as to guide the drive piston 22 over the entire axial stroke of the drive piston 22. The guide member 28*a* surrounds the gas spring chamber 48. The gas spring chamber 48 is formed by the drive piston 22 and the guide member 28*a*.

In order for the radial clearance 72 to function as an effective seal between the drive piston 22 and the piston cylinder 28 (or the guide member 28*a*), it is desirable that the radial width of the radial clearance 72 is 0.1 mm or less. From a viewpoint of easy manufacture, it is desirable that the radial width of the radial clearance 72 is 0.01 mm or more.

The radial clearance 72 may vary continuously or stepwise in the axial direction. Accordingly, the flow path resistance of the radial clearance 72 may vary depending on the axial position of the drive piston 22 with respect to the piston cylinder 28. Generally, the value of the flow path resistance is uniquely determined mainly from the shapes and dimensions of flow paths.

For example, the radial clearance 72 may have a first flow path resistance R1 when the drive piston 22 is at a first axial position (for example, the bottom dead center LP2), and may have a second flow path resistance R2 when the drive piston 22 is at a second axial position (for example, the top dead center UP2). Here, the first axial position may be closer to the bottom dead center LP2 of the drive piston 22 than the second axial position, and the first flow path resistance R1 may be larger than the second flow path resistance R2. In this way, a flow path resistance when the drive piston 22 is located at or near the bottom dead center LP2 can be made larger than a flow path resistance when the drive piston 22 is located at or near the top dead center UP2. As a result, the gas spring chamber 48 can more effectively generate the gas spring force that resists the downward movement of the drive piston 22, at or near the bottom dead center LP2 of the drive piston 22.

Figure 6:
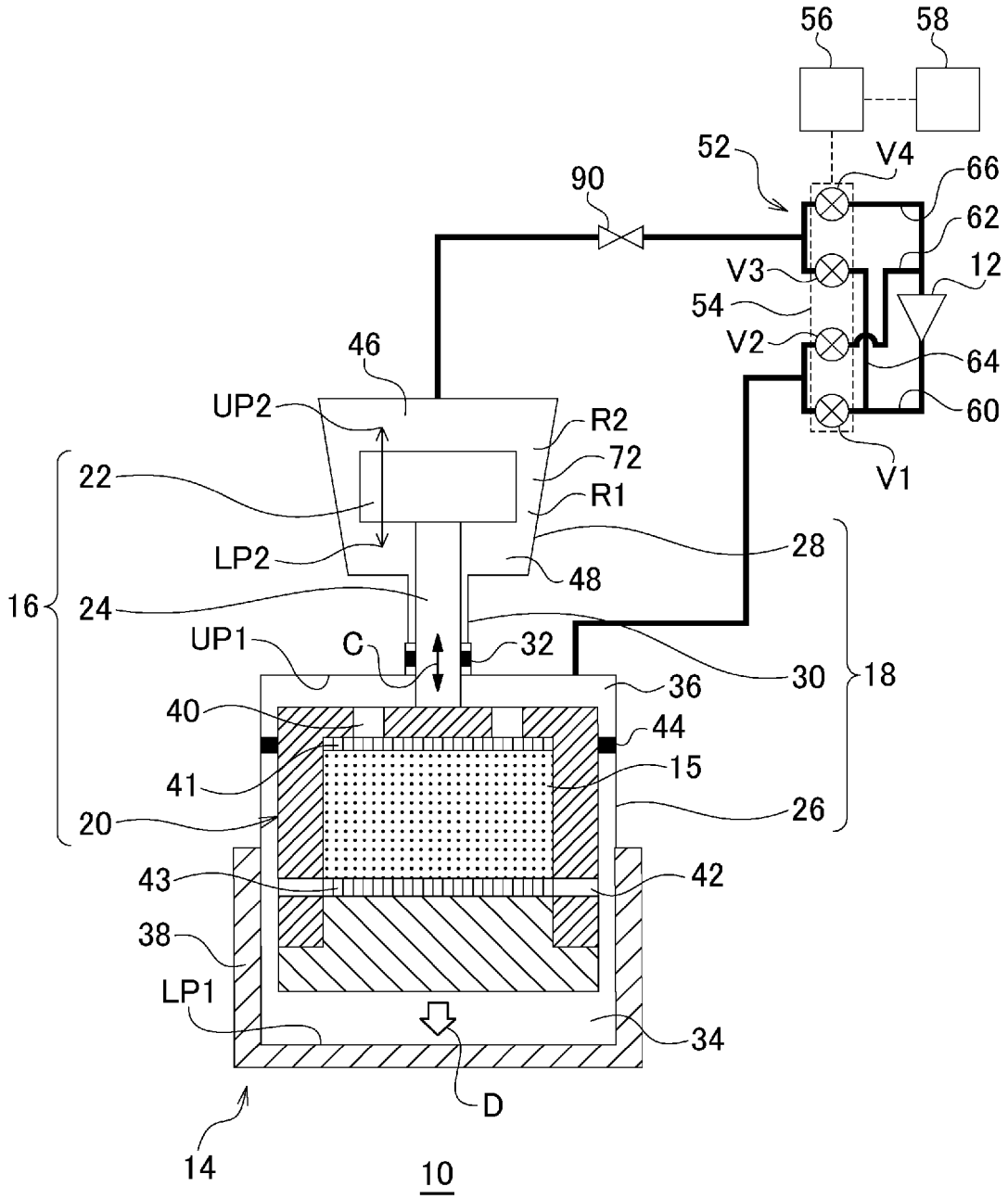
FIG. 6 is a schematic view illustrating the GM cryocooler related to the third embodiment.

As illustrated in FIG. 6, the radial clearance 72 may become stepwise narrower axially downward. Therefore, an inner peripheral surface of the piston cylinder 28 may be formed in a conical shape. In this way, the radial clearance 72 may vary continuously in the axial direction.

Figure 7:
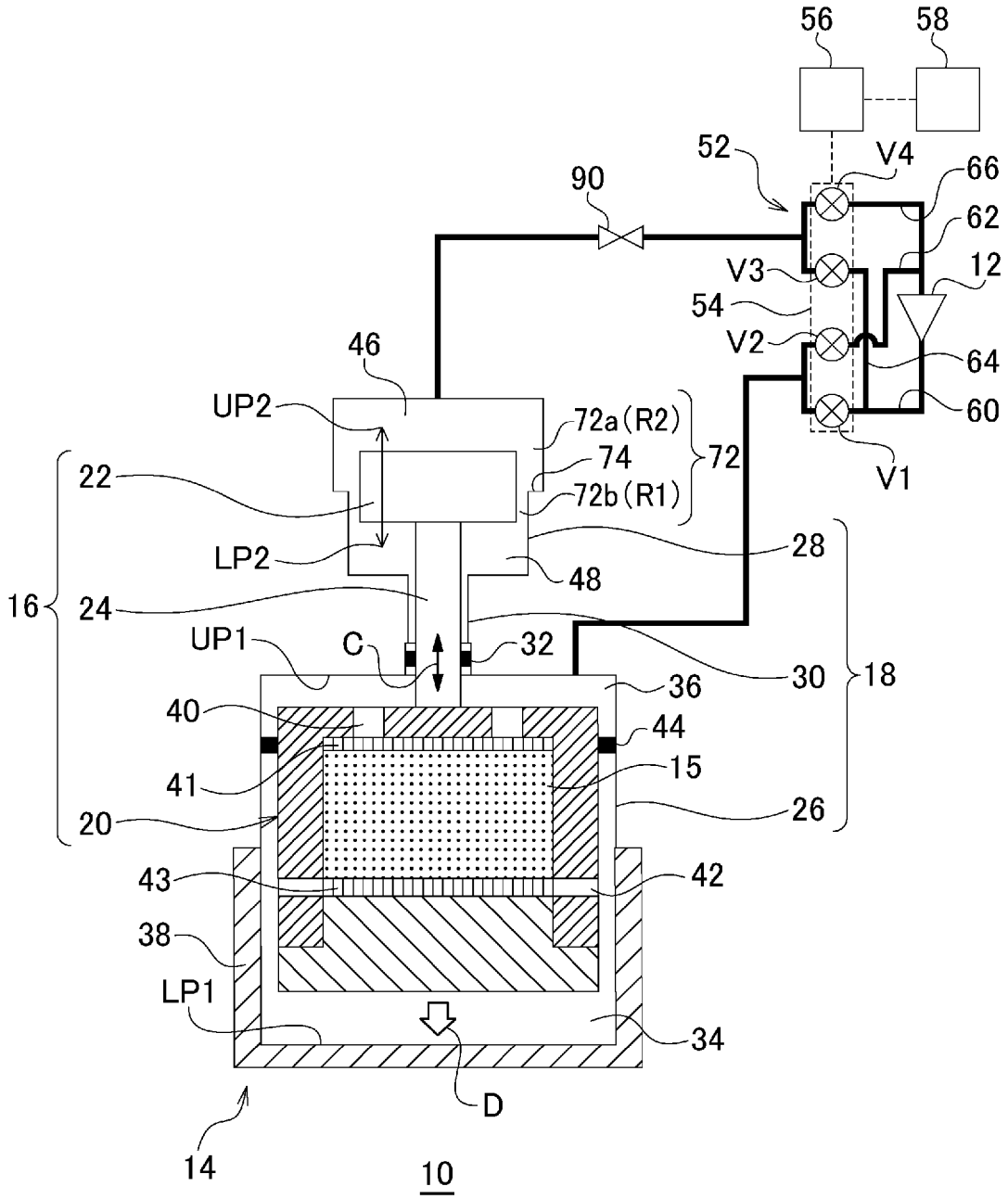
FIG. 7 is a schematic view illustrating the GM cryocooler related to the third embodiment.

As illustrated in FIG. 7, the radial clearance 72 includes a radial clearance upper part 72*a* having a second flow path resistance R2, and a radial clearance lower part 72*b* having the first flow path resistance R1. As described above, the first flow path resistance R1 is larger than the second flow path resistance R2. The radial clearance lower part 72*b* is adjacent to the radial clearance upper part 72*a* in the axial direction. Therefore, the gas spring chamber 48 is allowed to communicate with the drive chamber 46 through the radial clearance upper part 72*a* and the radial clearance lower part 72*b*. The radial widths of the radial clearance upper part 72*a* and the radial clearance lower part 72*b* are, for example, within a range of 0.01 to 0.1 mm.

The piston cylinder 28 includes a stepped part 74 to be a boundary between the radial clearance upper part 72*a* and the radial clearance lower part 72*b*. The piston cylinder 28 has a first internal diameter axially above the stepped part 74, and the piston cylinder 28 has a second internal diameter smaller than the first internal diameter, axially below the stepped part 74. Both the first internal diameter and the second internal diameter are larger than the external diameter of the drive piston 22. Therefore, the radial width of the radial clearance lower part 72*b* is narrower than the radial width of the radial clearance upper part 72*a*. In this way, the radial clearance 72 may vary stepwise in the axial direction.

Figure 8:
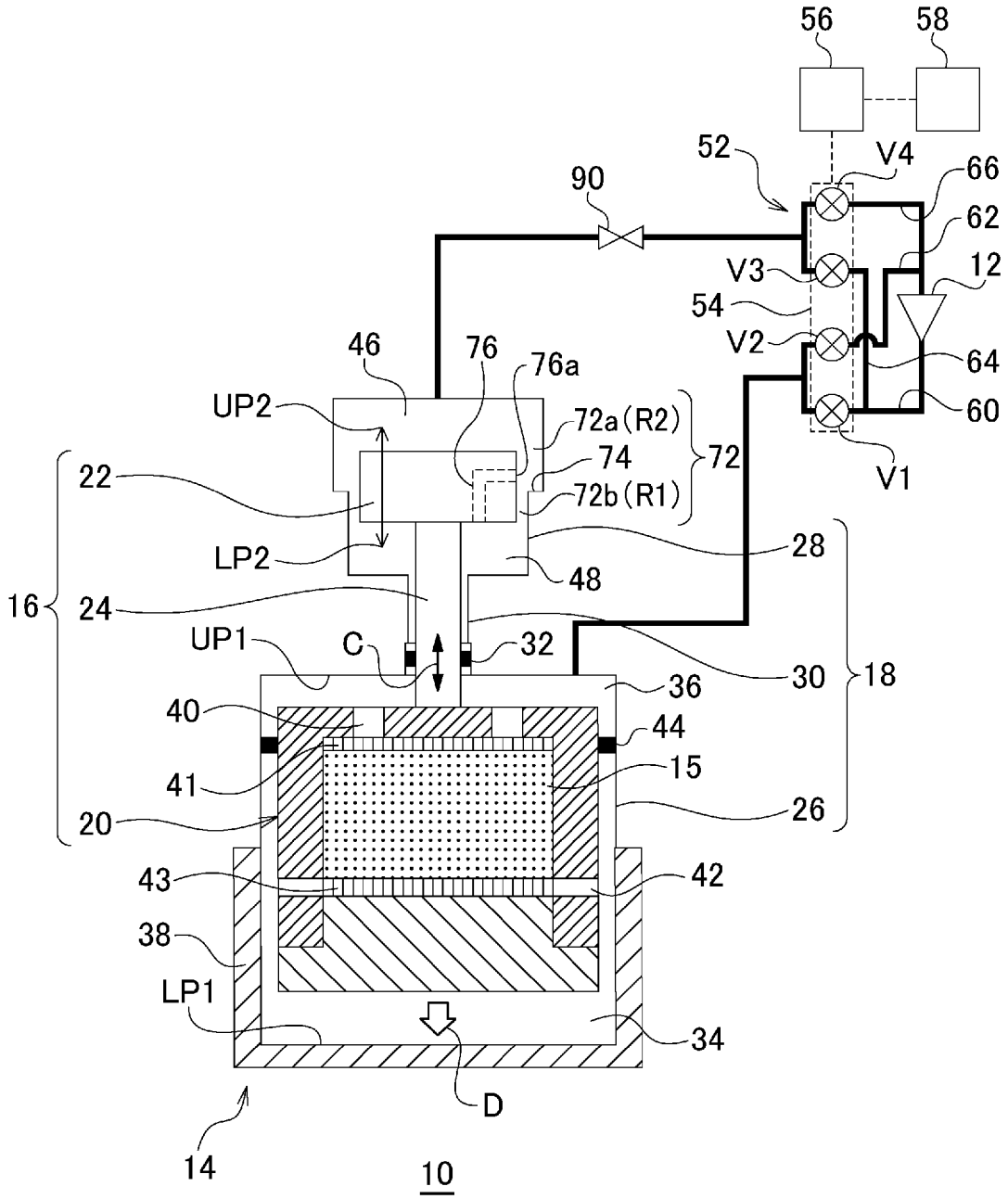
FIG. 8 is a schematic view illustrating the GM cryocooler related to the third embodiment.

As illustrated in FIG. 8, the drive piston 22 may include a communication path 76 that allows the gas spring chamber 48 to communicate with the radial clearance 72. The communication path 76 is a through-hole formed in the drive piston 22, and has an outlet 76*a* directed to the inner peripheral surface of the piston cylinder 28.

The communication path 76 is formed in the drive piston 22 so as to allow the gas spring chamber 48 to communicated with the radial clearance upper part 72*a* therethrough when the drive piston 22 is at the bottom dead center LP2 and allow the gas spring chamber 48 to communicate with the radial clearance lower part 72*b* therethrough when the drive piston 22 is at the top dead center UP2. In other words, the outlet 76*a* is disposed so as to be located below the stepped part 74 in the axial direction when the drive piston 22 is at the bottom dead center LP2 and be located above the stepped part 74 in the axial direction when the drive piston 22 is at the top dead center UP2.

In this case, the drive piston 22 can also be considered to constitute a flow rate control valve in cooperation with the piston cylinder 28. When the outlet 76*a* is located below the stepped part 74, the gas spring chamber 48 is allowed to communicate with the drive chamber 46 through the radial clearance lower part 72*b* (and the radial clearance upper part 72*a*). Since the flow path resistance of the radial clearance lower part 72*b* is large, the flow rate from the gas spring chamber 48 to the drive chamber 46 is limited. On the contrary, when the outlet 76*a* is located above the stepped part 74, the gas spring chamber 48 is allowed to communicate with the drive chamber 46 through the radial clearance upper part 72*a*. Since the flow path resistance of the radial clearance upper part 72*a* is small, the flow rate from the gas spring chamber 48 to the drive chamber 46 is increased.

It is desirable that the timing at which the outlet 76*a* passes by the stepped part 74 during the downward movement of the drive piston 22 is in a central region B of the first intake period A1 (an arrow indicated by FIG. 2). The central region B may be, for example, ¼ to ¾ of the first intake period A1. In this way, the gas spring force can be increased between the top dead center UP2 and the bottom dead center LP2 of the drive piston 22.

Figure 9:
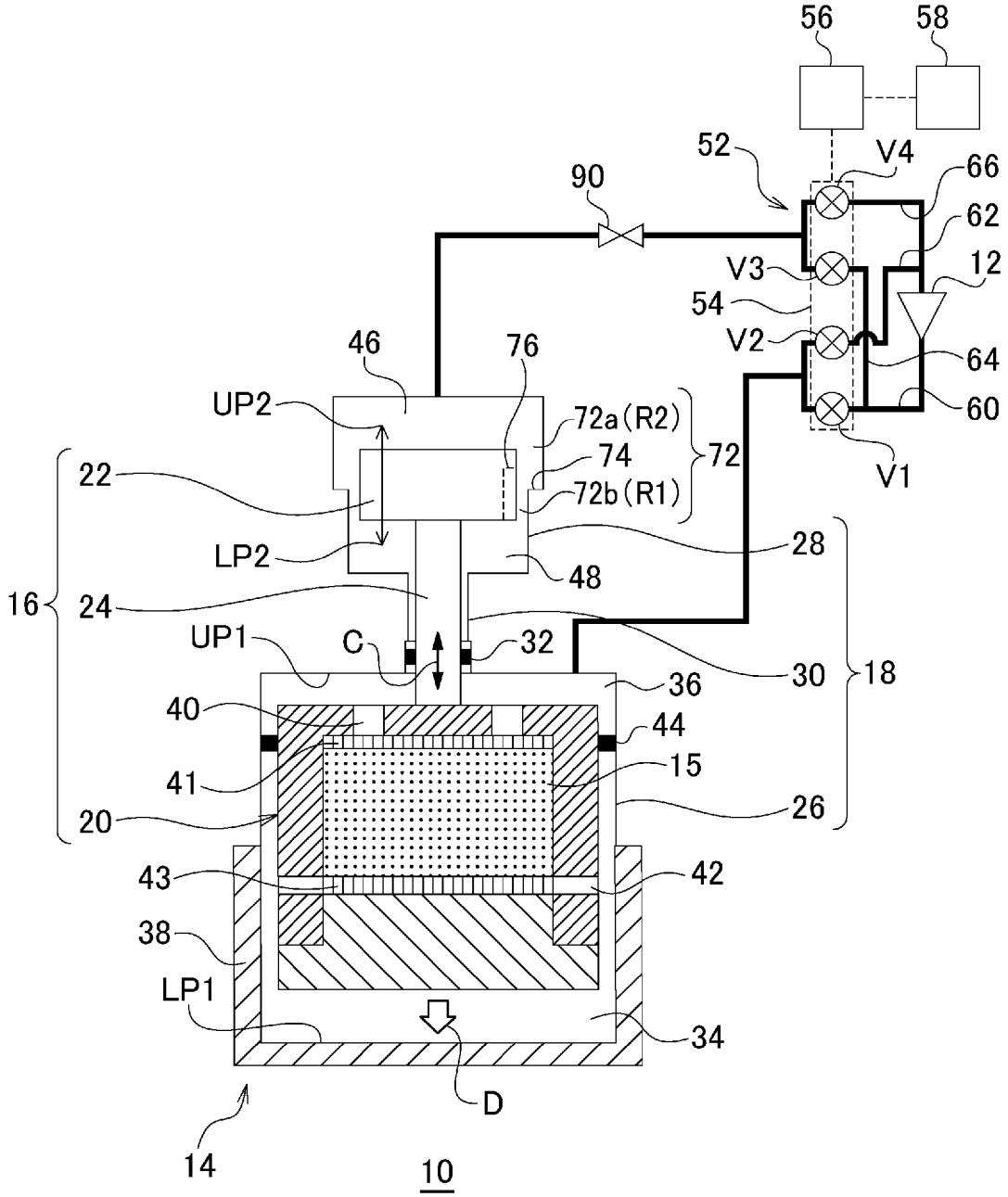
FIG. 9 is a schematic view illustrating the GM cryocooler related to the third embodiment.

As illustrated in FIG. 9, the communication path 76 may be a longitudinal groove formed in an outer peripheral surface of the drive piston 22. The longitudinal groove extends in the axial direction from the gas spring chamber 48 to a central part of the drive piston 22.

In FIGS. 8 and 9, the radial clearance lower part 72*b* may be extremely narrow or may be omitted. The third seal part 50 illustrated in FIG. 1 may be provided at the radial clearance lower part 72*b*. Additionally, although the number of communication paths 76 is one in the above-described example, a plurality of the communication paths 76 may be provided in the drive piston 22. In that case, the communication paths 76 may be formed at equal intervals of angles in a circumferential direction of the drive piston 22.

Figure 10A:
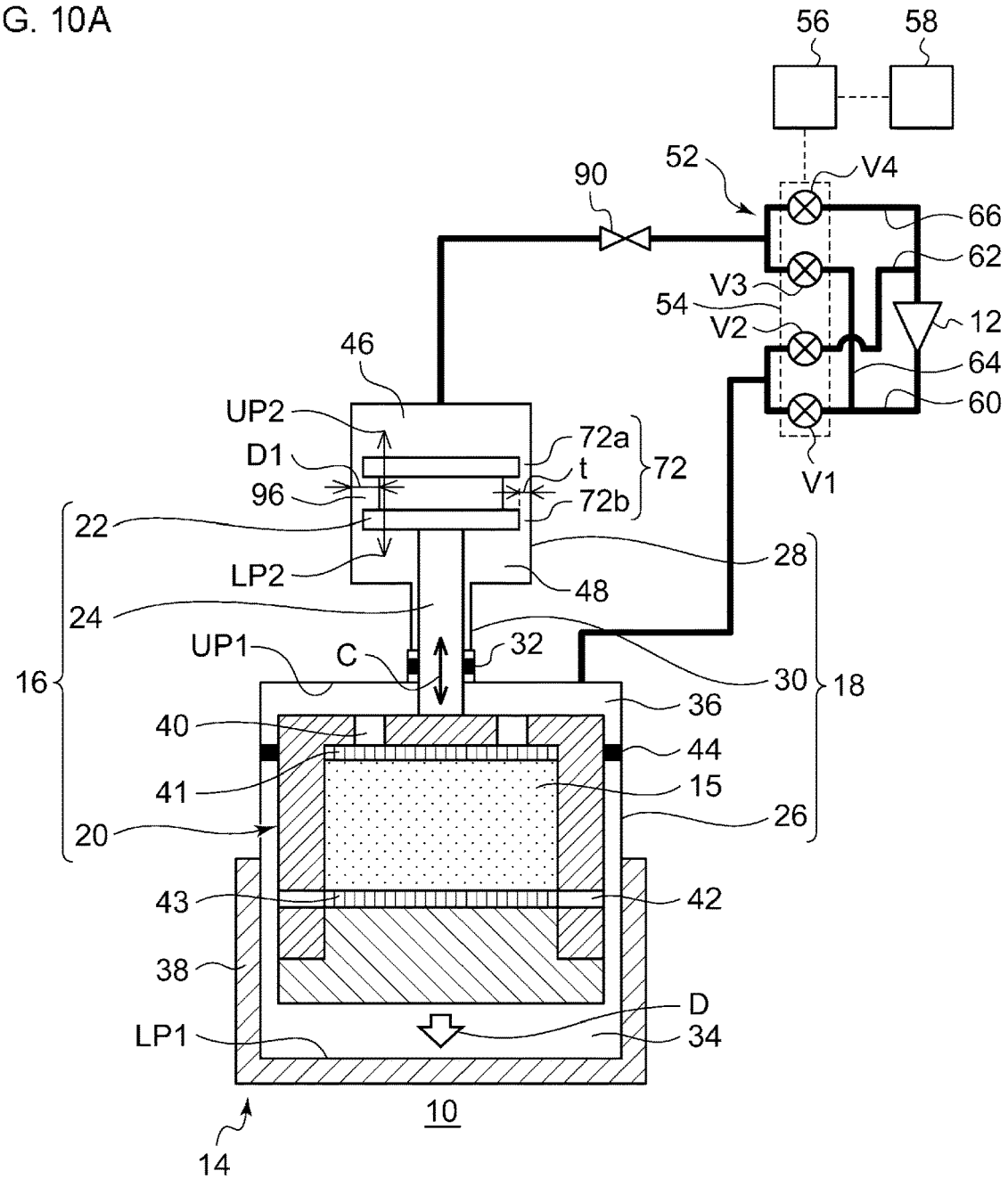
FIGS. 10A and 10B are schematic views illustrating the GM cryocooler related to the third embodiment.

As illustrated in FIG. 10A, the radial clearance 72 serving as a flow path resistance part may include a buffer volume part 96 that communicates with the radial clearance 72. The buffer volume part 96 is formed between the piston cylinder 28 and the drive piston 22.

The buffer volume part 96 is a groove or recess formed over the entire circumference on the side surface (outer peripheral surface) of the drive piston 22. A depth Dl of the buffer volume part 96 is larger than a radial width t of the radial clearance 72. For example, the depth D1 of the buffer volume part 96 may be 10 or more times the radial width t of the radial clearance 72.

The buffer volume part 96 is disposed at an axial intermediate part on the side surface of the drive piston 22, and communicates with the radial clearance upper part 72*a* and the radial clearance lower part 72*b*. The radial clearance upper part 72*a* and the radial clearance lower part 72*b* communicate with each other via the buffer volume part 96. In this example, although the radial widths of the radial clearance upper part 72*a* and the radial clearance lower part 72*b* are equal to each other, this is not essential, and the radial widths may be different from each other.

In this way, the buffer volume part 96 is connected to each of the drive chamber 46 and the gas spring chamber 48 through the radial clearance 72. The buffer volume part 96 is not directly connected to the drive chamber 46 and the gas spring chamber 48.

Since the buffer volume part 96 communicates with the drive chamber 46 and the gas spring chamber 48 through the radial clearance 72, the buffer volume part 96 can take an intermediate pressure between the drive chamber 46 and the gas spring chamber 48. When the drive chamber 46 is at a high pressure, gas may flow from the drive chamber 46 through the radial clearance upper part 72*a* into the buffer volume part 96. While the intermediate pressure of the buffer volume part 96 is lower than the high pressure of the drive chamber 46, the buffer volume part 96 can receive and temporarily store an incoming gas. Therefore, compared to a case where there is no buffer volume part 96, the flow rate of the gas that passes through the radial clearance 72 from the drive chamber 46 to the gas spring chamber 48 is suppressed. On the contrary, when the gas spring chamber 48 is at a high pressure, the buffer volume part 96 can receive the gas that flows in from the gas spring chamber 48 through the radial clearance lower part 72*b*. Compared to a case where there is no buffer volume part 96, the flow rate of the gas that passes through the radial clearance 72 from the drive chamber 46 to the gas spring chamber 48 is suppressed.

In this way, the buffer volume part 96 has an effect of suppressing the flow rate of the gas that passes through the radial clearance 72. Hence, the buffer volume part 96 can reduce the influence on sealing performance resulting from the fluctuation of the radial width of the radial clearance 72. Even if the radial width of the radial clearance 72 slightly deviates from design dimensions due to a manufacturing error, the fluctuation of the sealing performance of the radial clearance 72 is alleviated. It is easy to ensure the robustness of the radial clearance 72 when the GM cryocooler 10 is manufactured as a mass-produced product.

Figure 10B:
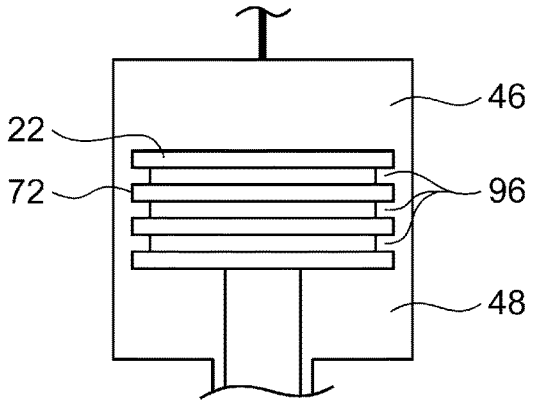

The shape of the buffer volume part 96 is optional. The buffer volume part 96 may be a groove or recess of any shape formed on the side surface of the drive piston 22. For example, as illustrated in FIG. 10B, the buffer volume part 96 may be a plurality of grooves formed on the side surface of the drive piston 22. These grooves extend parallel to each other over the entire circumference on the side surface of the drive piston 22. The buffer volume part 96 is connected to the drive chamber 46 and the gas spring chamber 48 through the radial clearance 72. In this way, the plurality of buffer volume parts 96 may be aligned in the axial direction on the side surface of the drive piston 22. Alternatively, instead of the plurality of grooves, the buffer volume part 96 may be one or a plurality of spiral grooves that are formed on the side surface of the drive piston 22. The buffer volume part 96 may not essentially extend over the entire circumference of the drive piston 22. For example, a plurality of recesses formed on the side surface of the drive piston 22 may be arranged in the circumferential direction.

As described with reference to FIGS. 8 and 9, in a case where the drive piston 22 is provided with the communication path 76, the buffer volume part 96 is formed so as not to communicate with the communication path 76. The buffer volume part 96 and the communication path 76 are separate gas spaces formed in the drive piston 22. Therefore, there is no direct gas flow between the buffer volume part 96 and the communication path 76. Therefore, the buffer volume part 96 is disposed on the side surface of the drive piston 22 so as to avoid the outlet 76*a* of the communication path 76. For example, in a case where a plurality of outlets 76*a* is provided, the plurality of buffer volume parts 96 and the plurality of outlets 76*a* may be disposed alternately in the circumferential direction. Alternatively, the buffer volume part 96 may be disposed at a location different from the outlet 76*a* in the axial direction.

It is not essential that the buffer volume part 96 is provided in the drive piston 22. The buffer volume part 96 may be provided in the piston cylinder 28 or may be provided, for example, on the inner peripheral surface of the guide member 28*a* illustrated in FIG. 5.

Figure 11:
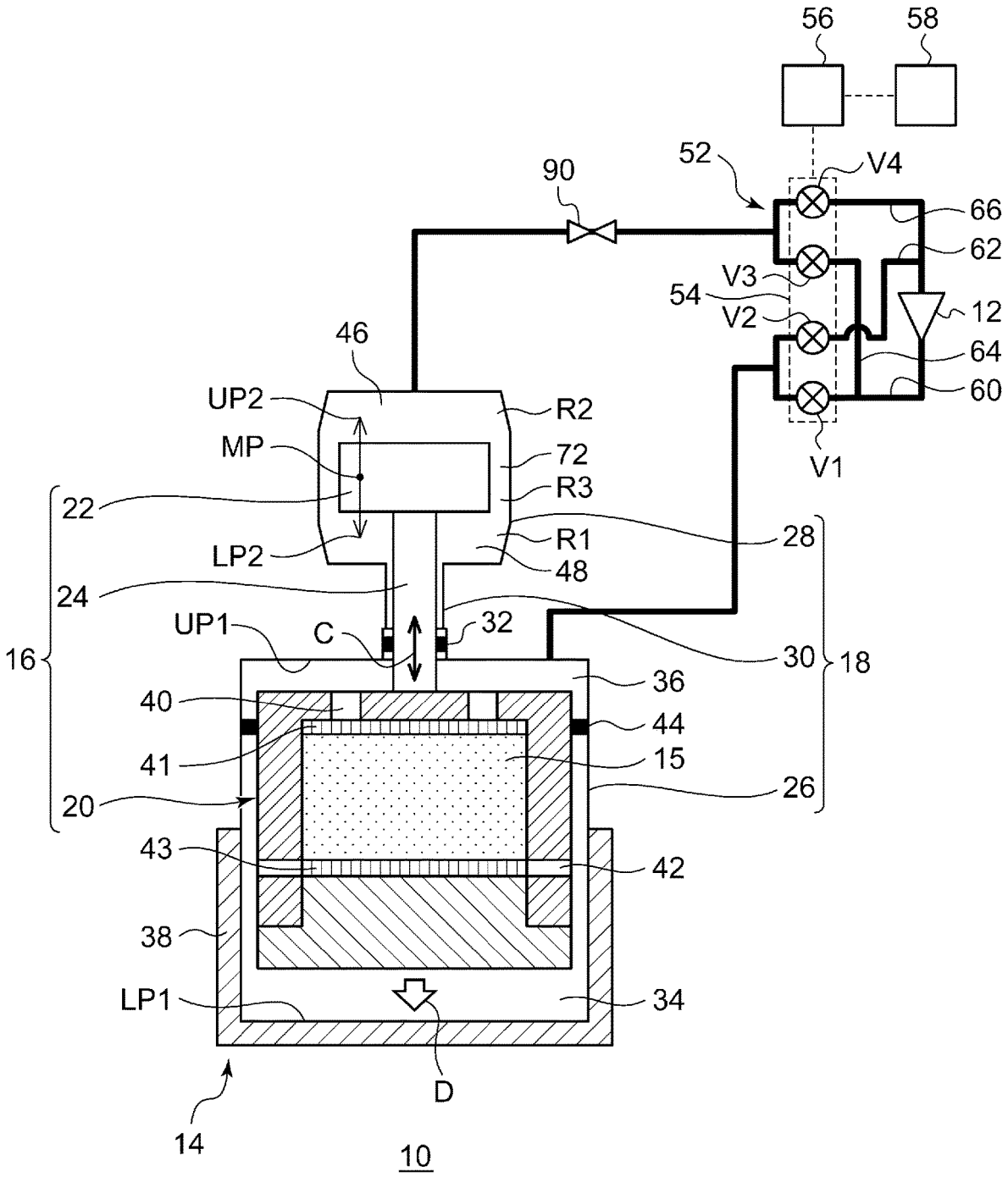
FIG. 11 is a schematic view illustrating the GM cryocooler related to the third embodiment.

As illustrated in FIG. 11, the radial clearance 72 serving as a flow path resistance part may have the first flow path resistance R1 when the drive piston 22 is at the first axial position (for example, the bottom dead center LP2), may have the second flow path resistance R2 when the drive piston 22 is at the second axial position (for example, the top dead center UP2), and may have a third flow path resistance R3 when the drive piston 22 is at a third axial position. Here, the third axial position may be located between the first axial position and the second axial position, and may be, for example, a midpoint MP between the bottom dead center LP2 and top dead center UP2. That is, an axial distance from the bottom dead center LP2 to the midpoint MP is equal to an axial distance from the top dead center UP2 to the midpoint MP.

The third flow path resistance R3 is smaller than the first flow path resistance R1 and smaller than the second flow path resistance R2. Although the first flow path resistance R1 may be larger than the second flow path resistance R2 as described above, this is not essential, and the first flow path resistance R1 may be smaller than the second flow path resistance R2.

In this way, when the drive piston 22 is located at or near the bottom dead center LP2, the gas spring chamber 48 can generate the gas spring force that resists the downward movement of the drive piston 22. Additionally, when the drive piston 22 is located at or near the top dead center UP2, the drive chamber 46 serving as the second gas spring chamber can generate the gas spring force that resists the upward movement of the drive piston 22.

In a case where the gas spring force is excessively strong, the upward and downward movements of the drive piston 22 are suppressed, and the stroke of the drive piston 22 becomes small. Along with this, the stroke of the displacer 20 also becomes small. This may lower PV (pressure-volume) work in the expansion chamber 34, and thus, may affect the cryocooling capacity of the GM cryocooler 10. As one of the measures of suppressing such an adverse effect, it is considered the stroke of the drive piston 22 is enlarged while lengthening the axial length of the piston cylinder 28. As a result, however, the size of the GM cryocooler 10 may become large.

By making the third flow path resistance R3 small as described above, the gas spring force acting on the drive piston 22 when the drive piston 22 moves by an intermediate part of the stroke thereof can be made small. Accordingly, the driving force of the displacer 20 resulting from the drive piston 22 becomes large, the stroke of the displacer 20 is maintained, and a decrease in cryocooling capacity of the GM cryocooler 10 can be suppressed.

As illustrated in FIG. 11, the radial clearance 72 may become stepwise wider axially downward from the drive chamber 46. As illustrated in FIG. 11, the radial clearance 72 may become stepwise wider axially upward from the gas spring chamber 48. In this way, the radial clearance 72 may vary continuously in the axial direction.

Figure 12:
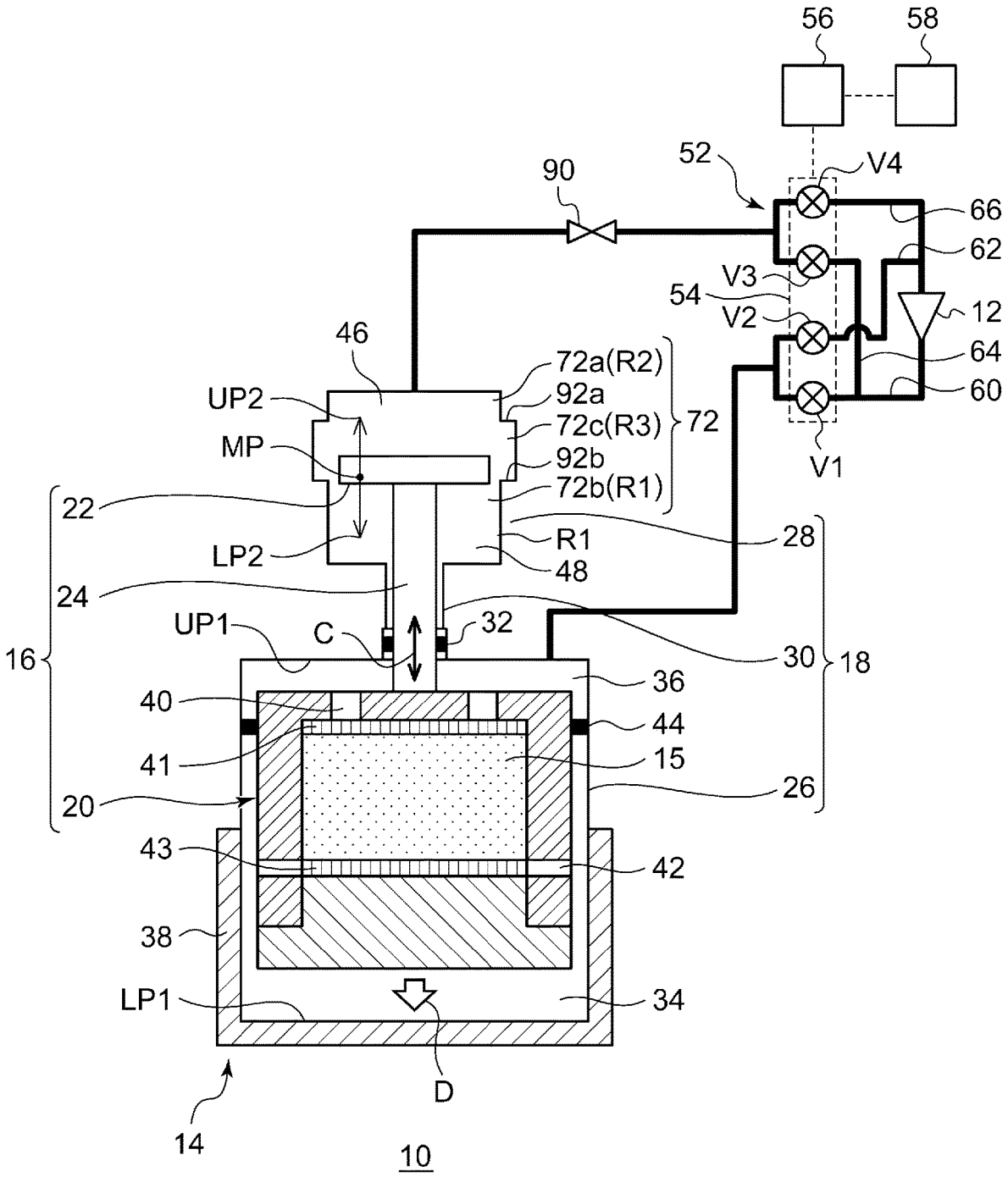
FIG. 12 is a schematic view illustrating the GM cryocooler related to the third embodiment.

As illustrated in FIG. 12, the radial clearance 72 includes the radial clearance upper part 72*a* having the second flow path resistance R2, the radial clearance lower part 72*b* having the first flow path resistance R1, and a radial clearance intermediate part 72*c* having the third flow path resistance R3. The top dead center UP2 of the drive piston 22 is located at the radial clearance upper part 72*a*, the bottom dead center LP2 of the drive piston 22 is located at the radial clearance lower part 72*b*, and the midpoint MP of the drive piston 22 is located at the radial clearance intermediate part 72*c*.

As described above, the third flow path resistance R3 is smaller than the first flow path resistance R1 and smaller than the second flow path resistance R2. The radial clearance intermediate part 72*c* is adjacent to the radial clearance upper part 72*a* in the axial direction. The radial clearance lower part 72*b* is adjacent to the radial clearance intermediate part 72*c* in the axial direction. Therefore, the gas spring chamber 48 is allowed to communicate with the drive chamber 46 through the radial clearance upper part 72*a*, the radial clearance intermediate part 72*c*, and the radial clearance lower part 72*b*.

The piston cylinder 28 includes a first stepped part 92*a* to be a boundary between the radial clearance upper part 72*a* and the radial clearance intermediate part 72*c*, and a second stepped part 92*b* to be a boundary between the radial clearance intermediate part 72*c* and the radial clearance lower part 72*b*. The piston cylinder 28 has a first internal diameter axially below the second stepped part 92*b*, has a second internal diameter axially above the first stepped part 92*a*, and has a third internal diameter between the first stepped part 92*a* and the second stepped part 92*b*. The third internal diameter is larger than the first internal diameter and larger than the second internal diameter. Any of the first internal diameter, the second internal diameter, and the third internal diameter is larger than the external diameter of the drive piston 22. Therefore, the radial width of the radial clearance intermediate part 72*c* is larger than the radial width of the radial clearance upper part 72*a* and larger than the radial width of the radial clearance lower part 72*b*. In this way, the radial clearance 72 may vary stepwise in the axial direction.

Figure 13:
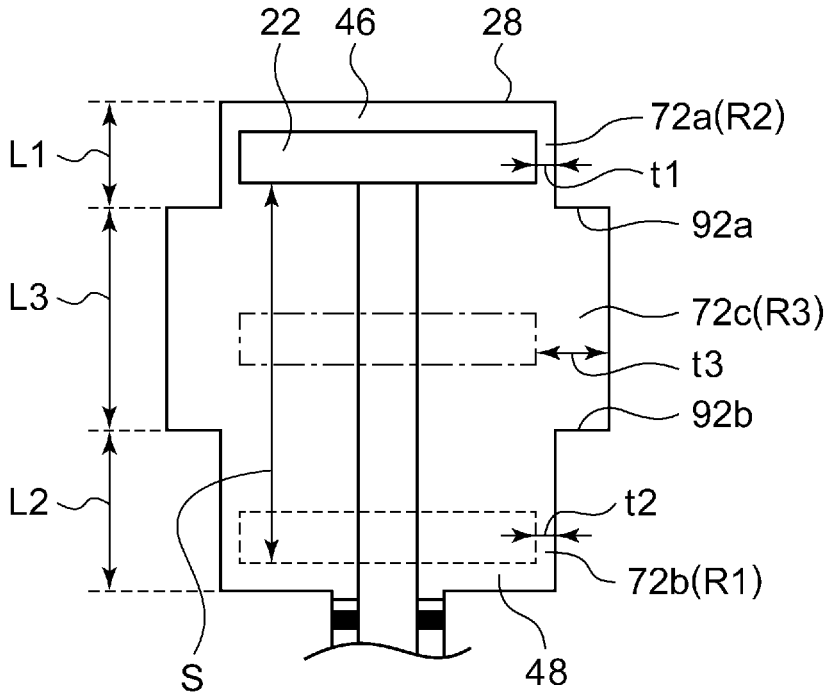
FIG. 13 is a schematic view illustrating the GM cryocooler related to the third embodiment.

A stroke S of the drive piston 22 illustrated in FIG. 12 is illustrated in FIG. 13. The drive piston 22 when being located at the top dead center UP2 is illustrated by a solid line, the drive piston 22 when being located at the bottom dead center LP2 is illustrated by a dashed line, and the drive piston 22 when being located in midpoint MP is illustrated by a one-dot chain line. As illustrated, the radial clearance upper part 72*a* has a first radial width t1, the radial clearance lower part 72*b* has a second radial width t2, and the radial clearance intermediate part 72*c* has a third radial width t3. The first radial width t1 is, for example, within a range of 0.01 to 0.1 mm, the second radial width t2 is, for example, within a range of 0.01 to 0.1 mm, and the third radial width t3 is, for example, within a range of 0.15 to 1.0 mm.

Additionally, the radial clearance upper part 72*a* has a first axial length L1, the radial clearance lower part 72*b* has a second axial length L2, and the radial clearance intermediate part 72*c* has a third axial length L3. The third axial length L3 of the radial clearance intermediate part 72*c* may be longer than half of the stroke S of the drive piston 22. The second axial length L2 of the radial clearance lower part 72*b* may be longer than the first axial length L1 of the radial clearance upper part 72*a*. Determining the axial length of the radial clearance 72 in this way helps to relatively shorten the axial length of the piston cylinder 28 while maintaining the stroke of the drive piston 22.

Figure 14:
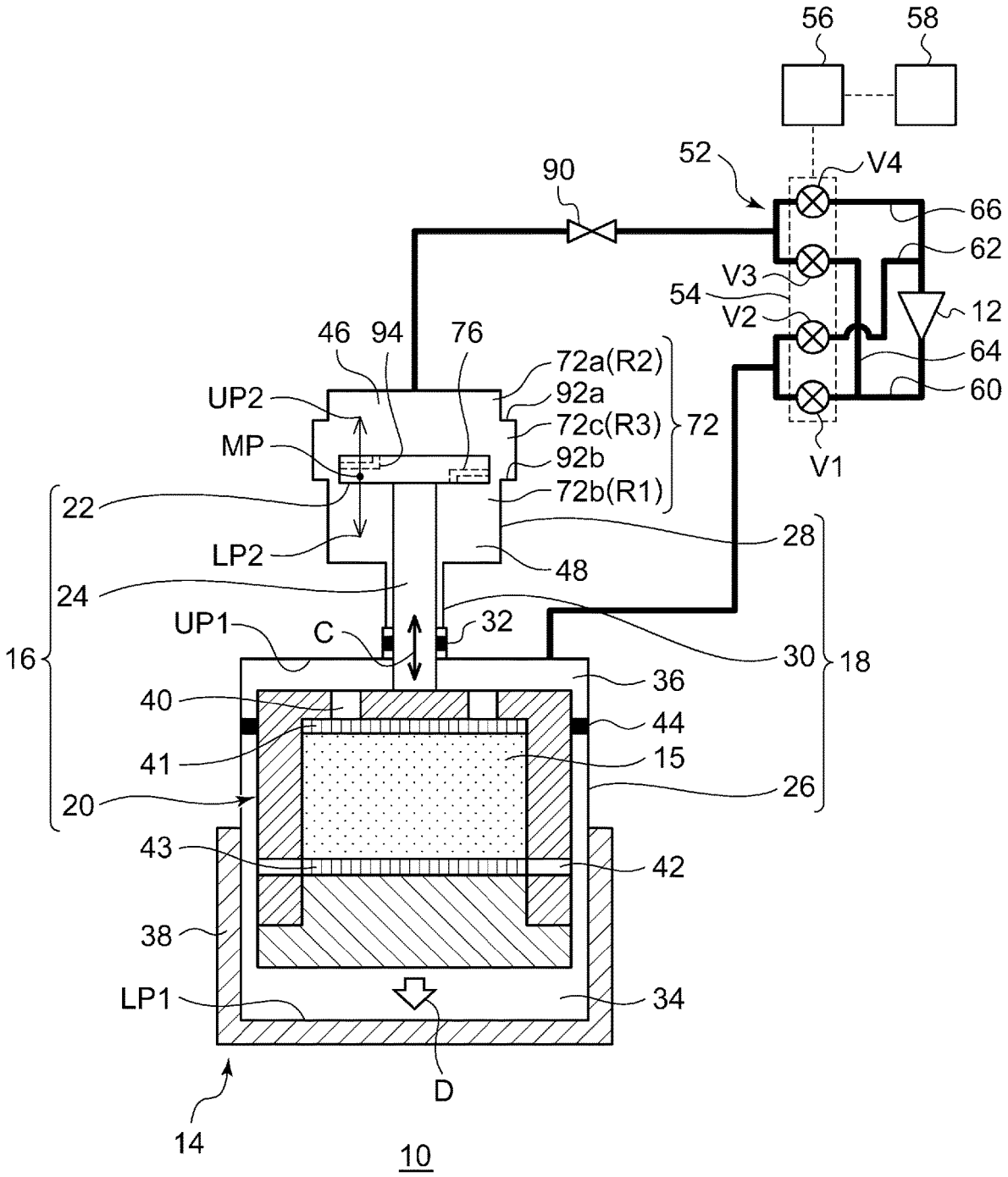
FIG. 14 is a schematic view illustrating the GM cryocooler related to the third embodiment.

As illustrated in FIG. 14, the drive piston 22 may include the communication path 76 that allows the gas spring chamber 48 to communicate with the radial clearance 72. The communication path 76 may be a through-hole formed in the drive piston 22. The communication path 76 functions similarly to the embodiment illustrated in FIG. 8. Additionally, as required, the drive piston 22 may include another communication path 94 that allows the drive chamber 46 to communicate with the radial clearance 72.

Figure 15:
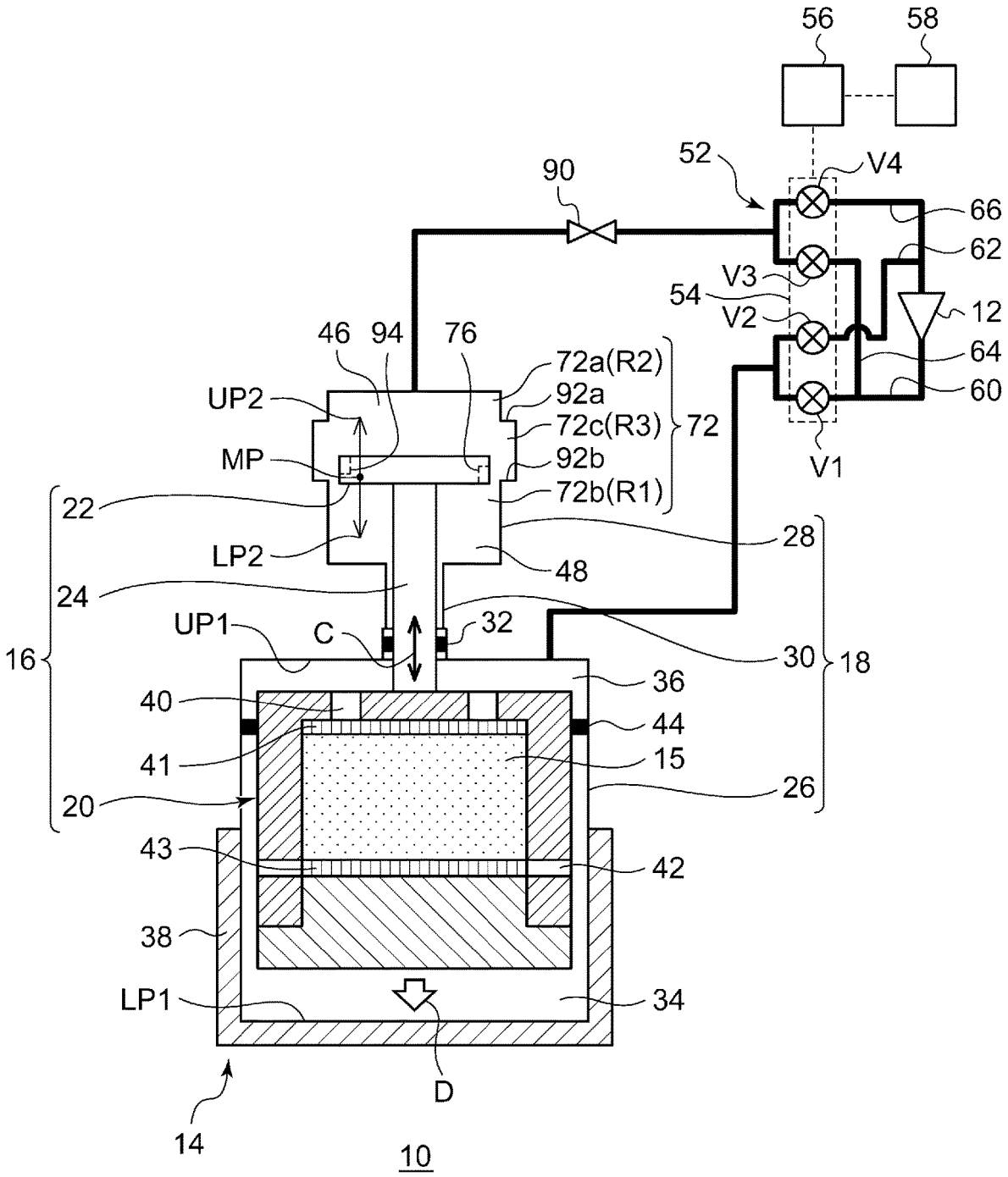
FIG. 15 is a schematic view illustrating the GM cryocooler related to the third embodiment.

As illustrated in FIG. 15, the communication path 76 may be the longitudinal groove formed in the outer peripheral surface of the drive piston 22. The longitudinal groove extends in the axial direction from the gas spring chamber 48 to the central part of the drive piston 22. The communication path 76 functions similarly to the embodiment illustrated in FIG. 9. Additionally, the other communication path 94 may also be a longitudinal groove.

Figure 16:
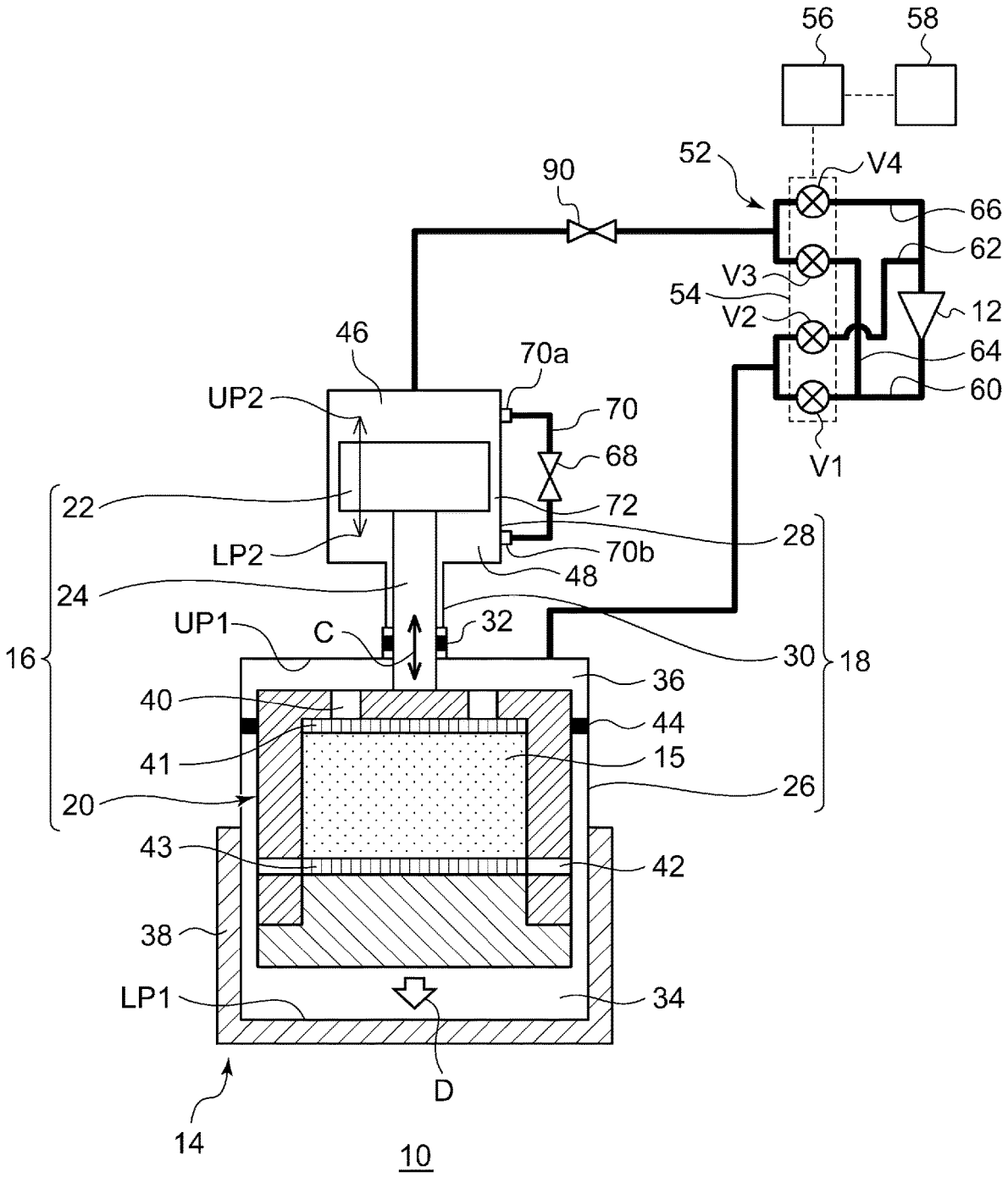
FIG. 16 is a schematic view illustrating the GM cryocooler related to the third embodiment.

Instead of providing the radial clearance 72 with the radial clearance intermediate part 72*c*, as illustrated in FIG. 16, the GM cryocooler 10 may include the pressure release path 70 together with the radial clearance 72. As described above, the pressure release path 70 is provided in the piston cylinder 28 so as to shunt the gas spring chamber 48 to the drive chamber 46. The flow path resistance part 68, such as an orifice, is disposed in the middle of the pressure release path 70. The pressure release path 70 includes a first outlet 70*a* on an axially upper side thereof, and includes a second outlet 70*b* on an axially lower side thereof.

In this way, when the drive piston 22 is located at or near the bottom dead center LP2 (that is, when the drive piston 22 is located axially below the second outlet 70*b*), the gas spring chamber 48 can generate the gas spring force that resists the downward movement of the drive piston 22. Additionally, when the drive piston 22 is located at or near the top dead center UP2 (that is, when the drive piston 22 is located axially above the first outlet 70*a*), the drive chamber 46 serving as the second gas spring chamber can generate the gas spring force that resists the upward movement of the drive piston 22.

When the drive piston 22 moves in the axial direction between the first outlet 70*a* and the second outlet 70*b*, the gas spring chamber 48 and the drive chamber 46 are allowed to communicate with each other through both the radial clearance 72 and the pressure release path 70. Hence, the gas spring force acting on the drive piston 22 when the drive piston 22 moves by an intermediate part of the stroke thereof can be made small. Accordingly, the driving force of the displacer 20 resulting from the drive piston 22 becomes large, the stroke of the displacer 20 is maintained, and a decrease in cryocooling capacity of the GM cryocooler 10 can be suppressed.

In addition, in FIG. 16, although the radial clearance 72 is constant in the axial direction, this is not essential. The radial clearance 72 may include the radial clearance upper part 72*a*, the radial clearance lower part 72*b*, and the radial clearance intermediate part 72*c*. In this case, the first outlet 70*a* may be provided at the radial clearance upper part 72*a*. The second outlet 70*b* may be provided at the radial clearance lower part 72*b*. Alternatively, the first outlet 70*a* and the second outlet 70*b* may be provided at the radial clearance intermediate part 72*c*.

Figure 17A:
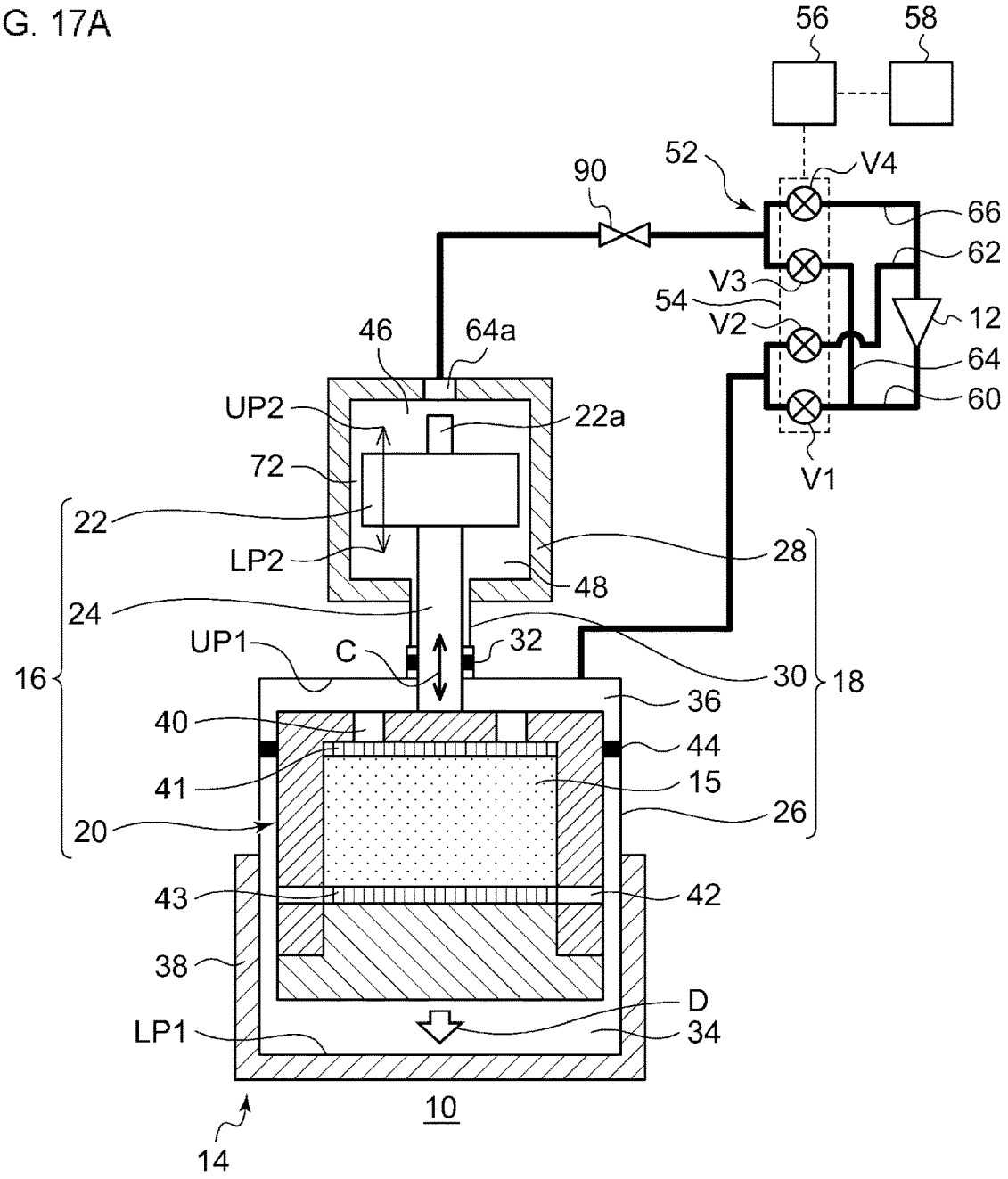
FIGS. 17A and 17B are schematic views illustrating the GM cryocooler related to the third embodiment.

As illustrated in FIG. 17A, a drive piston projection 22*a* may protrude in the axial direction from the upper surface of the drive piston 22. The drive piston projection 22*a* is disposed so as to be insertable into an outlet 64*a* of the second intake flow path 64 and advance into and retreat from the outlet 64*a* together with the axial reciprocation of the drive piston 22. The outlet 64*a* of the second intake flow path 64 is also an outlet of the second exhaust flow path 66. The outlet 64*a* is a gas inlet/outlet of a drive chamber for controlling the pressure of the drive chamber 46, and gas flows between the compressor 12 and the drive chamber 46 through the outlet 64*a*. The outlet 64*a* is formed to pass through an upper surface of the drive chamber 46 (that is, the piston cylinder 28).

The drive piston projection 22*a* is inserted into the outlet 64*a* of the second intake flow path 64 when the drive piston 22 is located at or near the top dead center UP2. The inserted drive piston projection 22*a* completely or partially blocks the outlet 64*a*, and thereby, the gas flow of the outlet 64*a* is hindered, or the flow rate of the gas that passes through the outlet 64*a* is limited. The drive piston projection 22*a* is withdrawn above the outlet 64*a* of the second intake flow path 64 when the drive piston 22 is separated from the top dead center UP2 or its vicinity. Therefore, the drive piston projection 22*a* is not inserted into the outlet 64*a* of the second intake flow path 64 but is located out of the outlet 64*a* when the drive piston 22 is located at or near the bottom dead center LP2. Since the drive piston projection 22*a* is out of the outlet 64*a*, the gas flow of the outlet 64*a* is recovered.

Hence, when the drive piston 22 moves upward toward the top dead center UP2, the drive piston projection 22*a* enters the outlet 64*a* of the second intake flow path 64, and as the drive piston 22 further moves upward and the drive chamber 46 becomes narrow, the pressure of the drive chamber 46 increases effectively. When the drive piston 22 is located at or near the top dead center UP2, the drive chamber 46 serving as the second gas spring chamber can generate the gas spring force that resists the upward movement of the drive piston 22. For example, even if either the second intake valve V3 or the second exhaust valve V4 is released, the gas flow rate of the outlet 64*a* is reduced due to the insertion of the drive piston projection 22*a* into the outlet 64*a* of the second intake flow path 64, and the drive chamber 46 can generate the gas spring force. In this way, a contact or collision between the axial movable body 16 and the cold head housing 18 is suppressed, and vibration or abnormal noise of the GM cryocooler 10 can be reduced.

Figure 17B:
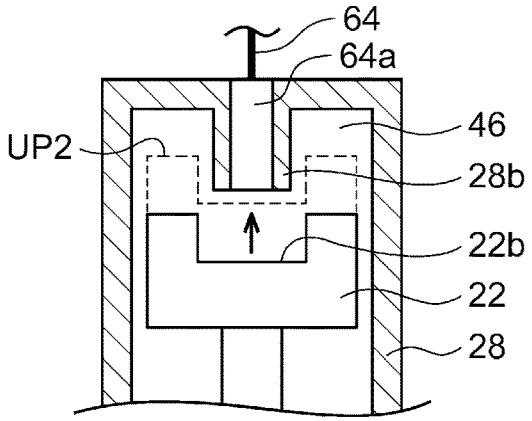

In addition, as illustrated in FIG. 17B, a projection 28*b*, which protrudes in the axial direction from an upper surface of the piston cylinder 28, may be formed so as to surround the outlet 64*a* of the second intake flow path 64, and a recess 22*b* capable of receiving the projection 28*b* may be formed on the upper surface of the drive piston 22. Even in this way, the projection 28*b* of the piston cylinder 28 is received in the recess 22*b* of the drive piston 22 when the drive piston 22 is located at or near the top dead center UP2. Accordingly, the outlet 64*a* is at least partially blocked by the drive piston 22 when the drive piston 22 is at the top dead center UP2. In this way, the gas flow of the outlet 64*a* is hindered, or the flow rate of the gas that passes through the outlet 64*a* is limited. Therefore, the drive chamber 46 can generate the gas spring force that resists the upward movement of the drive piston 22.

Figure 18:
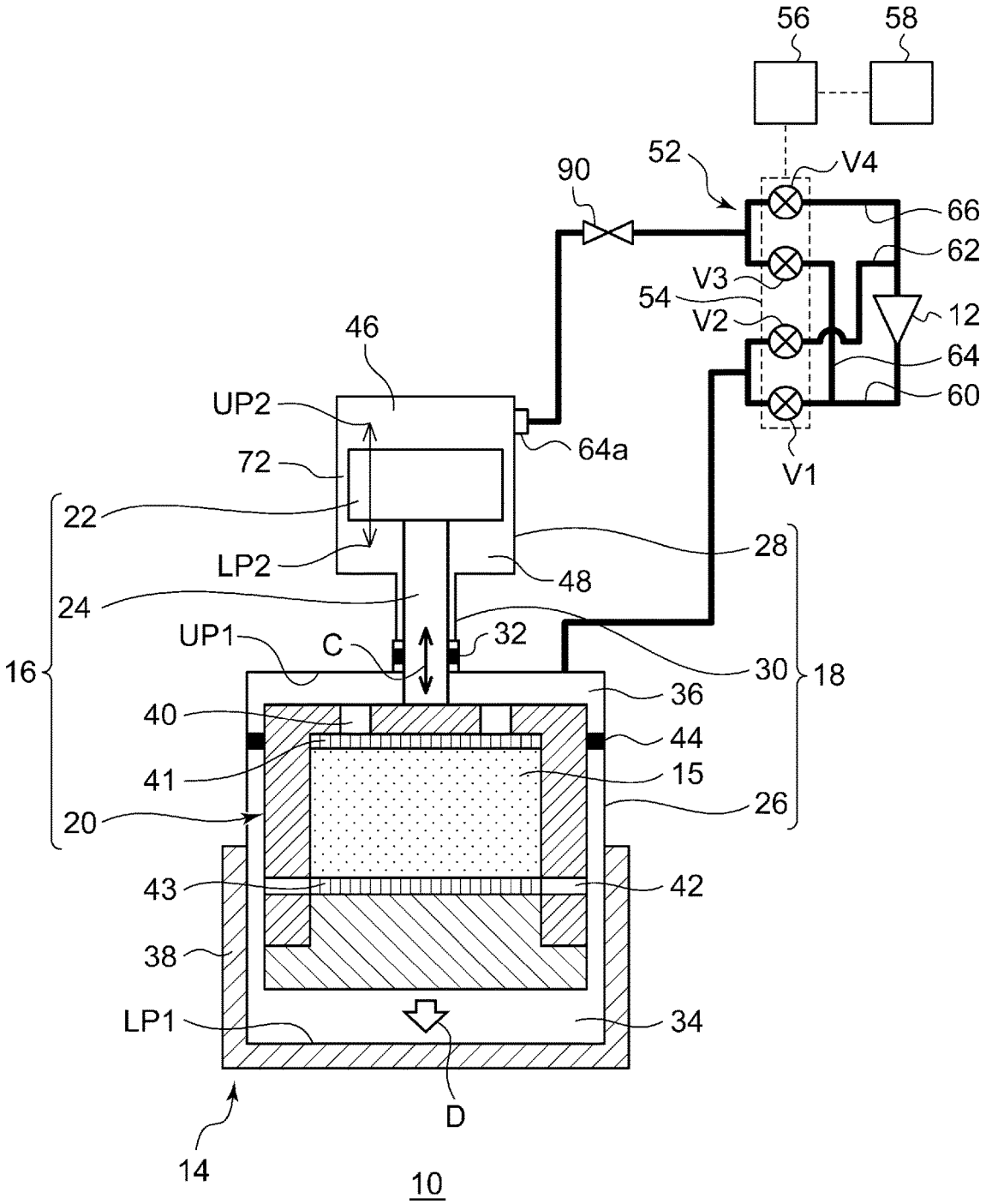
FIG. 18 is a schematic view illustrating the GM cryocooler related to the third embodiment.

As illustrated in FIG. 18, the outlet 64*a* of the second intake flow path 64 may be disposed on the side surface of the drive chamber 46 (that is, the piston cylinder 28).

When the drive piston 22 is located at or near the top dead center UP2 (that is, when the drive piston 22 is located axially above the outlet 64*a*), the side surface of the drive piston 22 faces the outlet 64*a*, and thereby, the gas flow of the outlet 64*a* is hindered, or the gas flow rate that passes through the outlet 64*a* is limited. Additionally, when the drive piston 22 moves downward, the outlet 64*a* is exposed to the drive chamber 46, and the gas flow of the outlet 64*a* is recovered. Even in this way, when the drive piston 22 is located at or near the top dead center UP2, the drive chamber 46 serving as the second gas spring chamber can effectively generate the gas spring force that resists the upward movement of the drive piston 22.

In addition, in FIGS. 17A, 17B, and 18, although the radial clearance 72 is constant in the axial direction, this is not essential. Similar to the embodiment illustrated in FIGS. 7 to 9, the radial clearance 72 may include the radial clearance upper part 72*a* and the radial clearance lower part 72*b*. In this case, the outlet 64*a* may be provided at the radial clearance upper part 72*a*. Similar to the embodiment illustrated in FIGS. 11 to 15, the radial clearance 72 may include the radial clearance upper part 72*a*, the radial clearance lower part 72*b*, and the radial clearance intermediate part 72*c*. The outlet 64*a* may be provided at the radial clearance upper part 72*a* or the radial clearance intermediate part 72*c*.

Fourth Embodiment

Figure 19:
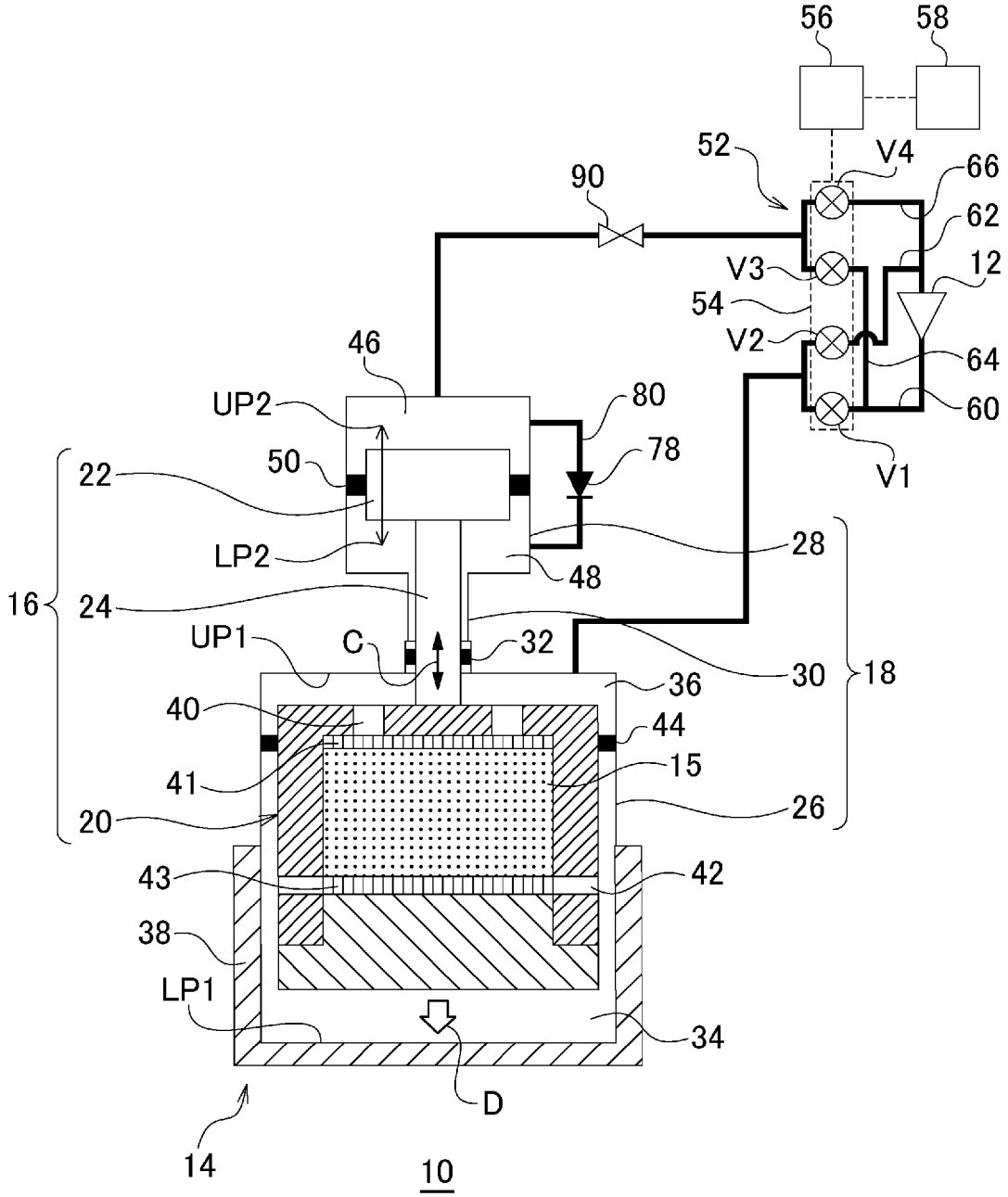
FIG. 19 is a schematic view illustrating a GM cryocooler related to a fourth embodiment.
Figure 20:
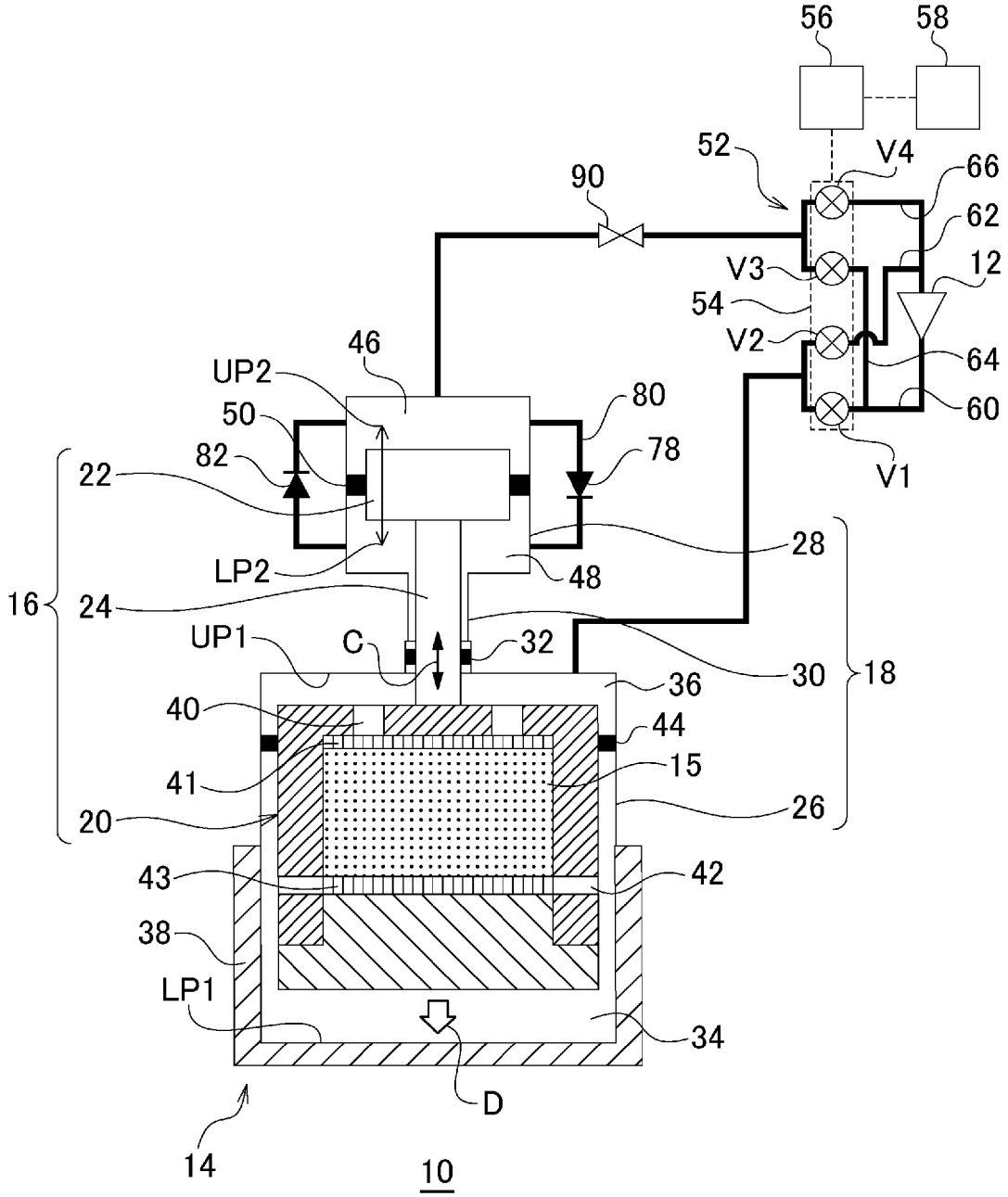
FIG. 20 is a schematic view illustrating a GM cryocooler related to a fourth embodiment.
Figure 21:
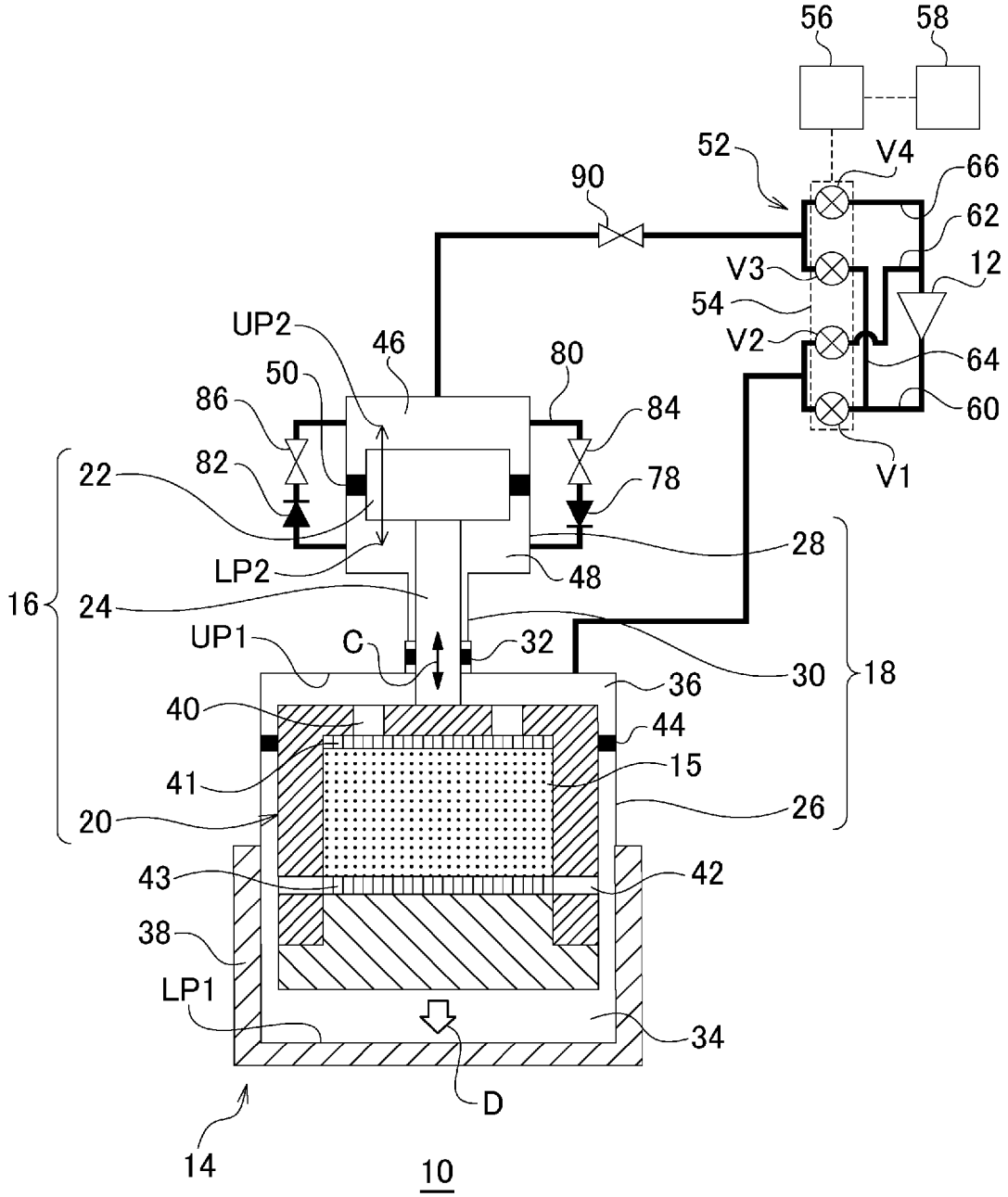
FIG. 21 is a schematic view illustrating the GM cryocooler related to the fourth embodiment.

FIGS. 19 to 21 are schematic views illustrating a GM cryocooler 10 related to a fourth embodiment. The GM cryocooler 10 related to the fourth embodiment is the same as the GM cryocooler 10 related to the first embodiment except that a check valve 78 is provided with a shunt path 80.

As illustrated in FIG. 19, the check valve 78 is disposed between the gas spring chamber 48 and the drive chamber 46 so as to resist the outflow of gas from the gas spring chamber 48 to the drive chamber 46. The piston cylinder 28 includes the shunt path 80 that shunts the gas spring chamber 48 to the drive chamber 46. The check valve 78 is disposed in the middle of the shunt path 80.

In this way, when the drive piston 22 moves downward, the check valve 78 is closed. Therefore, the drive piston 22 can compress the gas stored in the gas spring chamber 48. Similar to the first embodiment, a contact or collision between the axial movable body 16 and the cold head housing 18 is suppressed, and vibration or abnormal noise of the GM cryocooler 10 can be reduced.

As illustrated in FIG. 20, a second check valve 82 that allows the gas spring chamber 48 and the drive chamber 46 to communicate with each other may be provided in parallel with the check valve (hereinafter referred to as the first check valve) 78. However, the second check valve 82 is provided in an orientation reverse to the check valve 78, and resists the outflow of gas from the drive chamber 46 to the gas spring chamber 48. A set differential pressure for opening the first check valve 78 is open is smaller than a set differential pressure for opening the second check valve 82. Even in this way, vibration or abnormal noise of the GM cryocooler 10 can be reduced. Additionally, an excessive pressure in the gas spring chamber 48 can be released to the drive chamber 46.

As illustrated in FIG. 21, a flow path resistance part may be connected in series with a check valve. A first flow path resistance part 84 is connected in series with the first check valve 78, and a second flow path resistance part 86 is connected in series with the second check valve 82. The first flow path resistance part 84 has a smaller low flow path resistance than the second flow path resistance part 86. The set differential pressure for opening the first check valve 78 may be equal to the set differential pressure for opening the second check valve 82. Even in this way, the same effects as those of the configuration illustrated in FIG. 20 can be exhibited.

The invention has been described above on the basis of the embodiments. It should be understood by those skilled in the art that the invention is not limited to the above embodiments, that various design changes are possible and various modification examples are possible, and that such modification examples are also within the scope of the invention.

In a certain embodiment, a flow path resistance part 90 may be provided between the drive chamber 46 and the valve unit 54. The flow path resistance part 90 may be provided between the drive chamber 46 and the second intake valve V3 in the second intake flow path 64. In this way, in an exhaust process (the first exhaust period A2 illustrated in FIG. 2) of the cold head 14, a delay occurs in the pressure rising (the second intake period A3 illustrated in FIG. 2) of the drive chamber 46. Accordingly, rising of a downward driving force that acts on the drive piston 22 can be delayed. This helps to suppress a contact or collision between the axial movable body 16 and the cold head housing 18 and reduce vibration or abnormal noise of the GM cryocooler 10.

In a case where the GM cryocooler 10 is designed so as to be upwardly installed, the disposition of the drive chamber 46 and the gas spring chamber 48 may be reversed. The gas spring chamber 48 may be disposed axially opposite to the displacer cylinder 26 with respect to the drive piston 22, and the drive chamber 46 may be disposed on the same axial side as the displacer cylinder 26 with respect to the drive piston 22.

Various features described in relation to the embodiments can also be applied to other embodiments. New embodiments created by combination have the effects of respective combined embodiments in combination. For example, the check valve described in relation to the fourth embodiment may be applied to the first embodiment to the third embodiment.

The invention is applicable to the field of the GM cryocooler.

It should be understood that the invention is not limited to the above-described embodiment, but may be modified into various forms on the basis of the spirit of the invention. Additionally, the modifications are included in the scope of the invention.

What is claimed is:

1. A GM cryocooler comprising:

a displacer that is reciprocatable in an axial direction;

a displacer cylinder that houses the displacer;

a drive piston that is coupled to the displacer so as to drive the displacer in the axial direction; and a piston cylinder that houses the drive piston and that includes a drive chamber of which a pressure is controlled to drive the drive piston, and a gas spring chamber which is airtightly formed with respect to the displacer cylinder and is partitioned from the drive chamber by the drive piston, wherein the drive chamber is formed at a first end of the piston cylinder away from the displacer cylinder in the axial direction and the gas spring chamber is formed at a second end of the piston cylinder toward the displacer cylinder in the axial direction, wherein the drive piston is configured to increase a pressure of the gas spring chamber upon movement of the drive piston widening the drive chamber and narrowing the gas spring chamber such that the increased pressure of the gas spring chamber generates a gas spring force that resists the movement of the drive piston toward the gas spring chamber.

2. The GM cryocooler according to claim 1, further comprising:

a radial clearance formed between the piston cylinder and the drive piston to allow the gas spring chamber to communicate with the drive chamber and acting as a flow path resistance against outflow of gas from the gas spring chamber to the drive chamber.

3. The GM cryocooler according to claim 2, wherein the flow path resistance part includes a radial clearance formed between the piston cylinder and the drive piston, and wherein the radial clearance has a first flow path resistance when the drive piston is at a bottom dead center, has a second flow path resistance when the drive piston is at a top dead center, and the first flow path resistance is larger than the second flow path resistance.

4. The GM cryocooler according to claim 3, wherein the radial clearance includes a radial clearance upper part having the second flow path resistance, and a radial clearance lower part that is adjacent to the radial clearance upper part in the axial direction and has the first flow path resistance, and wherein the piston cylinder includes a stepped part to be a boundary between the radial clearance upper part and the radial clearance lower part.

5. The GM cryocooler according to claim 4, wherein the drive piston includes a communication path that is formed so as to allow the gas spring chamber to communicate with the radial clearance lower part when the drive piston is at the bottom dead center and allow the gas spring chamber to communicate with the radial clearance upper part when the drive piston is at the top dead center.

6. The GM cryocooler according to claim 3, wherein the flow path resistance part includes a radial clearance formed between the piston cylinder and the drive piston, wherein the radial clearance is configured to have a first flow path resistance when the drive piston is at a bottom dead center, have a second flow path resistance when the drive piston is at a top dead center, and have a third flow path resistance when the drive piston is at a midpoint between the bottom dead center and the top dead center, and wherein the third flow path resistance is smaller than the first flow path resistance and is smaller than the second flow path resistance.

7. The GM cryocooler according to claim 6, wherein the radial clearance includes a radial clearance upper part having the second flow path resistance, a radial clearance intermediate part that is adjacent to the radial clearance upper part in the axial direction and has the third flow path resistance, and a radial clearance lower part that is adjacent to the radial clearance intermediate part in the axial direction and has the first flow path resistance.

8. The GM cryocooler according to claim 7, wherein an axial length of the radial clearance intermediate part is longer than half of a stroke of the drive piston, and an axial length of the radial clearance lower part is longer than an axial length of the radial clearance upper part.

9. The GM cryocooler according to claim 3, wherein the flow path resistance part includes a buffer volume part that is formed between the piston cylinder and the drive piston and communicates with the radial clearance.

10. The GM cryocooler according to claim 1, wherein the drive chamber includes a gas inlet/outlet for controlling the pressure of the drive chamber, and wherein the gas inlet/outlet is at least partially blocked by the drive piston when the drive piston is at a top dead center.

11. The GM cryocooler according to claim 1, further comprising:

a check valve that is disposed between the gas spring chamber and the drive chamber so as to resist outflow of gas from the gas spring chamber to the drive chamber.

* * * * *